US010901338B2

(12) United States Patent
Noro

(10) Patent No.: US 10,901,338 B2
(45) Date of Patent: Jan. 26, 2021

(54) IMAGE FORMING APPARATUS WITH PHOTOSENSITIVE DRUM EXPOSED BY LINEARLY-ARRANGED LIGHT EMISSION ELEMENTS HAVING AN OVERLAP

(71) Applicant: CANON KABUSHIKI KAISHA, Tokyo (JP)

(72) Inventor: Toshitaka Noro, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/675,773

(22) Filed: Nov. 6, 2019

(65) Prior Publication Data

US 2020/0166863 A1 May 28, 2020

(30) Foreign Application Priority Data

Nov. 22, 2018 (JP) ..... 2018-219722

(51) Int. Cl.
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS 6,052,140 A * 4/2000 Yoshida ..... B41J 2/45 347/116

FOREIGN PATENT DOCUMENTS

| | | |
|---|---|---|
| EP | 1528501 | 5/2005 |
| EP | 2444850 | 4/2012 |
| JP | 2005-074906 | 3/2005 |
| JP | 2005-254739 | 9/2005 |
| JP | 2006-205387 | 8/2006 |
| JP | 2007-160650 | 6/2007 |
| JP | 2012-161953 | 8/2012 |
| JP | 2013-146891 | 8/2013 |
| JP | 2014-184622 | 10/2014 |

OTHER PUBLICATIONS

Extended European Search Report dated Apr. 20, 2020 in counterpart EP Application No. 19207353.4.

* cited by examiner

*Primary Examiner* — Susan S Lee
(74) *Attorney, Agent, or Firm* — Venable LLP

(57) ABSTRACT

An image forming apparatus includes a rotatable photosensitive drum together with first and second chips which include plural light emission elements arranged along a rotational axis of the photosensitive drum so as to expose the photosensitive drum to light emitted therefrom for each of one line extending along the rotational axis. Parts of the first and second chips overlap in a direction perpendicular to the rotational axis. A controller controls actuation of said light emitting elements on the basis of image data, wherein for the overlapped parts, the light emission pattern is controlled to be different for every predetermined number of the lines.

20 Claims, 19 Drawing Sheets

(a)

| | PWM DATA | | | | | | | |
|---|---|---|---|---|---|---|---|---|
| 000 | 0 | 0 | 0 | 0 | 0 | 0 | 0 | 0 |
| 001 | 0 | 0 | 0 | 0 | 0 | 0 | 1 | 1 |
| 010 | 0 | 0 | 0 | 0 | 1 | 1 | 1 | 1 |
| 011 | 0 | 0 | 1 | 1 | 1 | 1 | 1 | 1 |
| 100 | 1 | 1 | 1 | 1 | 1 | 1 | 1 | 1 |

(b)

| | PWM DATA | | | | | | | |
|---|---|---|---|---|---|---|---|---|
| 000 | 0 | 0 | 0 | 0 | 0 | 0 | 0 | 0 |
| 001 | 1 | 1 | 0 | 0 | 0 | 0 | 0 | 0 |
| 010 | 1 | 1 | 1 | 1 | 0 | 0 | 0 | 0 |
| 011 | 1 | 1 | 1 | 1 | 1 | 1 | 0 | 0 |
| 100 | 1 | 1 | 1 | 1 | 1 | 1 | 1 | 1 |

(c)

| | PWM DATA | | | | | | | |
|---|---|---|---|---|---|---|---|---|
| 000 | 0 | 0 | 0 | 0 | 0 | 0 | 0 | 0 |
| 001 | 0 | 0 | 0 | 1 | 1 | 0 | 0 | 0 |
| 010 | 0 | 0 | 1 | 1 | 1 | 1 | 0 | 0 |
| 011 | 0 | 1 | 1 | 1 | 1 | 1 | 1 | 0 |
| 100 | 1 | 1 | 1 | 1 | 1 | 1 | 1 | 1 |

FIG.8

| PATTRNS | MEMORY (N : 501～528) | OVLP 1 | OVLP 2 | OVLP 3 | OVLP 4 |
|---|---|---|---|---|---|
| 1 | MEMORY N | 1 | 1 | 1 | 1 |
| | MEMORY +1 | 0 | 0 | 0 | 0 |
| 2 | MEMORY N | 1 | 1 | 1 | 0 |
| | MEMORY +1 | 0 | 0 | 0 | 1 |
| 3 | MEMORY N | 1 | 1 | 0 | 1 |
| | MEMORY +1 | 0 | 0 | 1 | 0 |
| 4 | MEMORY N | 1 | 1 | 0 | 0 |
| | MEMORY +1 | 0 | 0 | 1 | 1 |
| 5 | MEMORY N | 1 | 0 | 1 | 1 |
| | MEMORY +1 | 0 | 1 | 0 | 0 |
| 6 | MEMORY N | 1 | 0 | 1 | 0 |
| | MEMORY +1 | 0 | 1 | 0 | 1 |
| 7 | MEMORY N | 1 | 0 | 0 | 1 |
| | MEMORY +1 | 0 | 1 | 1 | 0 |
| 8 | MEMORY N | 1 | 0 | 0 | 0 |
| | MEMORY +1 | 0 | 1 | 1 | 1 |
| 9 | MEMORY N | 0 | 0 | 0 | 0 |
| | MEMORY +1 | 1 | 1 | 1 | 1 |
| 10 | MEMORY N | 0 | 0 | 0 | 1 |
| | MEMORY +1 | 1 | 1 | 1 | 0 |
| 11 | MEMORY N | 0 | 0 | 1 | 0 |
| | MEMORY +1 | 1 | 1 | 0 | 1 |
| 12 | MEMORY N | 0 | 0 | 1 | 1 |
| | MEMORY +1 | 1 | 1 | 0 | 0 |
| 13 | MEMORY N | 0 | 1 | 0 | 0 |
| | MEMORY +1 | 1 | 0 | 1 | 1 |
| 14 | MEMORY N | 0 | 1 | 0 | 1 |
| | MEMORY +1 | 1 | 0 | 1 | 0 |
| 15 | MEMORY N | 0 | 1 | 1 | 0 |
| | MEMORY +1 | 1 | 0 | 0 | 1 |
| 16 | MEMORY N | 0 | 1 | 1 | 1 |
| | MEMORY +1 | 1 | 0 | 0 | 0 |

FIG.15

IMAGE FORMING APPARATUS WITH PHOTOSENSITIVE DRUM EXPOSED BY LINEARLY-ARRANGED LIGHT EMISSION ELEMENTS HAVING AN OVERLAP

FIELD OF THE INVENTION AND RELATED ART

The present invention relates to an image forming apparatus such as a printer which exposes a photosensitive drum using an exposure head.

In a printer which is an electrophotographic image forming apparatus, a method of exposing a photosensitive drum using an exposure head to form a latent image is generally known. Here, a LED (Light Emitting Diode) or an organic EL (Organic Electro Luminescence) is used for the exposure head. The exposure head comprises a light emitting element array arranged in the longitudinal direction of the photosensitive drum, and a rod lens array which forms an image of light from the light emitting element array, on the photosensitive drum. LEDs and organic ELs having a surface-emitting shape in which the direction of light emitted from the light-emitting surface is the same as that of the rod lens array is known. Here, the length of the light emitting element array is determined depending on the width of the image area on the photosensitive drum, and the interval between the light emitting elements is determined according to the resolution of the printer. For example, in the case of a 1200 dpi printer, the pixel spacing is 21.16 μm, and therefore, the spacing between the adjacent light emitting elements is also the spacing corresponding to 21.16 μm. In a printers which use such an exposure head, as compared to laser scanning printers which scan a photosensitive drum with a laser beam deflected by a rotating polygonal mirror, use a smaller number of parts, and therefore, downsizing of equipment and cost reduction are easy. In addition, in a printer using an exposure head, the sound generated by the rotation of the rotary polygonal mirror is eliminated.

In an exposure head using LEDs, a plurality of light emitting element array chips are arranged in a staggered pattern. That is, they are alternately arranged in the main scanning direction for scanning the photosensitive drum in the upper and lower rows of the photosensitive drum rotational direction. Furthermore, the light emitting element array chips adjacent in the vertical direction in which the photosensitive drum rotates are arranged as follows. That is, among the light emitting elements inside the light emitting element array chip adjacent to the rotational direction of the photosensitive drum, one or more light emitting elements arranged at the end are arranged at a position or positions overlapping the light emitting element at the end of the adjacent light emitting element array chip in the rotational direction of the photosensitive drum. As described above, in an exposure head using a LED, a structure is generally used in which an image can be formed with an arrangement in which a plurality of light emitting elements are overlapped in the rotational direction of a photosensitive drum. However, depending on the mounting state of the light emitting element array chip, a positional deviation of about several μm occurs at the joint. This misalignment may result in image formation at the joints as a black stripe or a white stripe. Therefore, techniques have been proposed for removing the strike which occurs in such joints. For example, Japanese Patent Laid-Open No. 2005-254739 describes a control method by controlling the light emitting elements which belong to different array regions and which have the shortest distance in the overlapping portion of the light emitting elements so that each has a light in density of 50%, by which the influence of stripes produced at the joints is alleviated. In addition, for example, Japanese Patent Application Laid-Open No. 2006-205387 discloses a method, in which means are provided to measure the gap of the joint, and the light emission points of the light emitting elements are shifted according to the measurement results to reduce stripe which appears at the joints.

However, when the exposure head generates heat, the internal printed circuit board may thermally expand, with the result that the joint interval between the light emitting element array chips mounted on the printed circuit board may increase. In such a case, in the conventional method described above, a deviation occurs in the interval between the light emitting elements in the overlapping portion of the light emitting element array chip, and the light intensity balance of the multiplexed (overlapping) light emitting points is lost. As a result, in image formation, the photosensitive drum is continuously exposed with a broken light intensity balance in the multiplexed light emission points, and an image of black stripes or white stripes may be formed on the recording material.

SUMMARY OF THE INVENTION

According to an aspect of the present invention, there is provided an image forming apparatus comprising a rotatable photosensitive drum; a substrate; first and second chips provided on a side of said substrate and including a plurality of light emission elements arranged along a rotational axis of said photosensitive drum, said light emission elements being configured to expose said photosensitive drum to light emitted therefrom, for each of one line extending along the rotational axis; and a controller configured to control actuation of said light emitting elements on the basis of image data; wherein said first chip and said second chip are arranged such that a part of said first chip and a part of said second chip are overlapped as seen in a direction perpendicular to the rotational axis, and wherein said controller controls a pattern of actuation and non-actuation of said light emission element in the overlapped part of said first chip and actuation and non-actuation of said light emission element in the overlapped part of said second chip, such that the pattern is different for every predetermined number of the lines.

According to another aspect of the present invention, there is provided an image forming apparatus comprising a rotatable photosensitive drum; a substrate; first and second chips provided on a side of said substrate and including a plurality of light emission elements arranged along a rotational axis of said photosensitive drum, said light emission elements being configured to expose said photosensitive drum to light emitted therefrom, for each of one line extending along the rotational axis; and a controller configured to control actuation of said light emitting elements on the basis of image data; wherein said first chip and said second chip are arranged such that a part of said first chip and a part of said second chip are overlapped as seen in a direction perpendicular to the rotational axis, and wherein said controller controls a pattern of relatively higher and lower intensities of the light emitted by said light emission element in the overlapped part of said first chip and said light emission element in the overlapped part of said second chip, such that the pattern is different for every predetermined number of the lines.

Further features of the present invention will become apparent from the following description of exemplary embodiments with reference to the mounted drawings.

Figure 2:
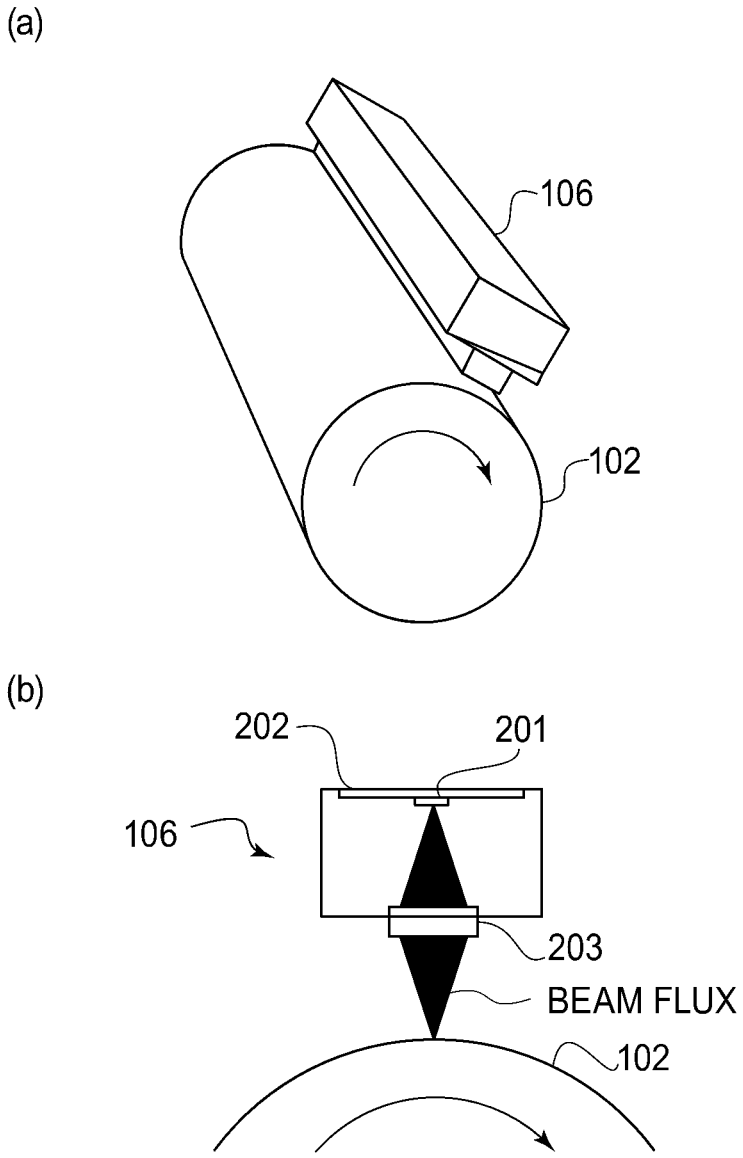

Parts (a) and (b) of FIG. 2 are views illustrating the positional relationship between the exposure head and the photosensitive drum in Embodiments 1 and 2, and a view illustrating the structure of the exposure head.

Figure 3:
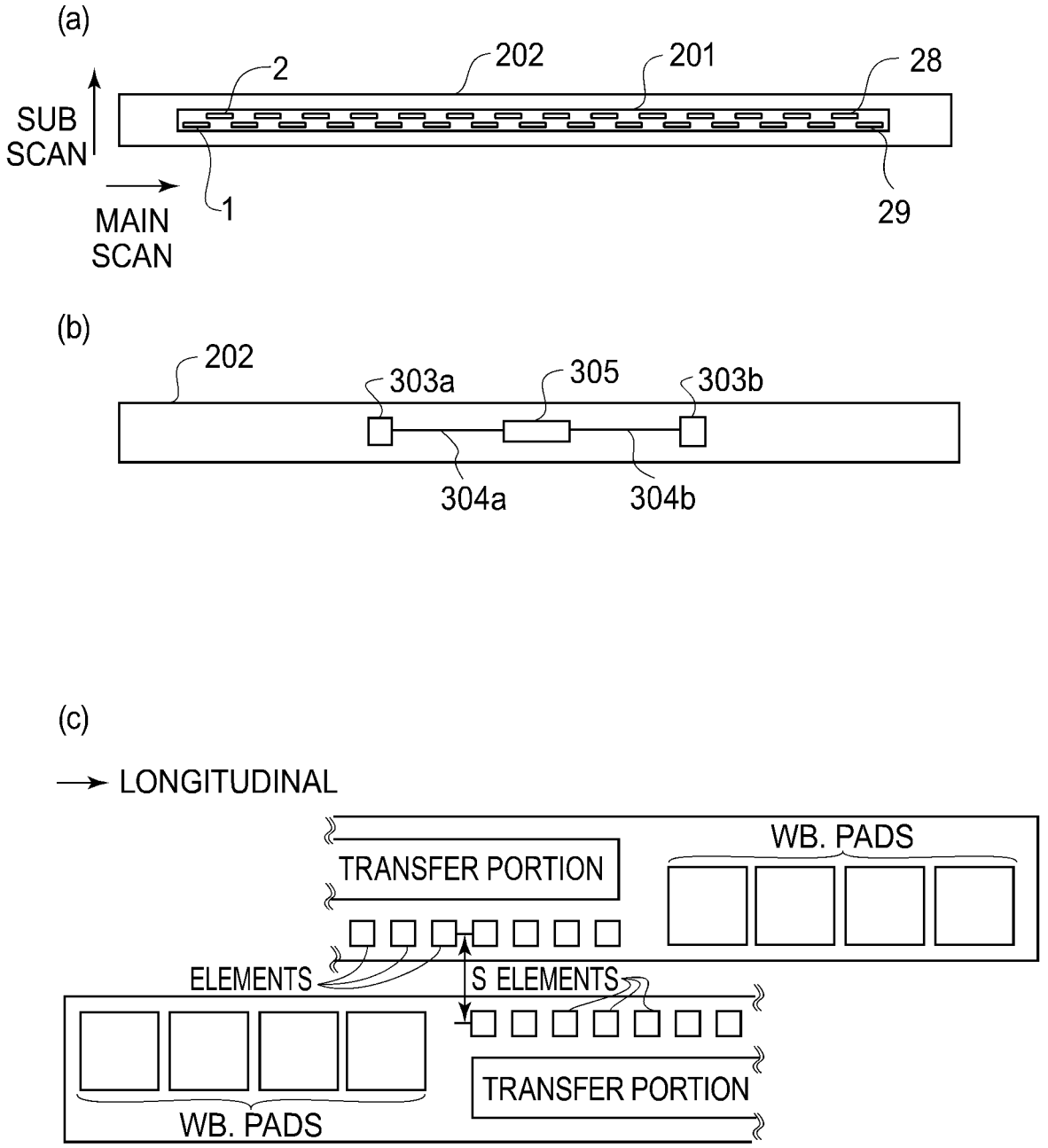

Parts (a), (b) and (c) FIG. 3 are schematic illustrations of the printed circuit board of Embodiments 1 and 2, and an illustration of the structure of the light emitting element array chip.

Figure 4:
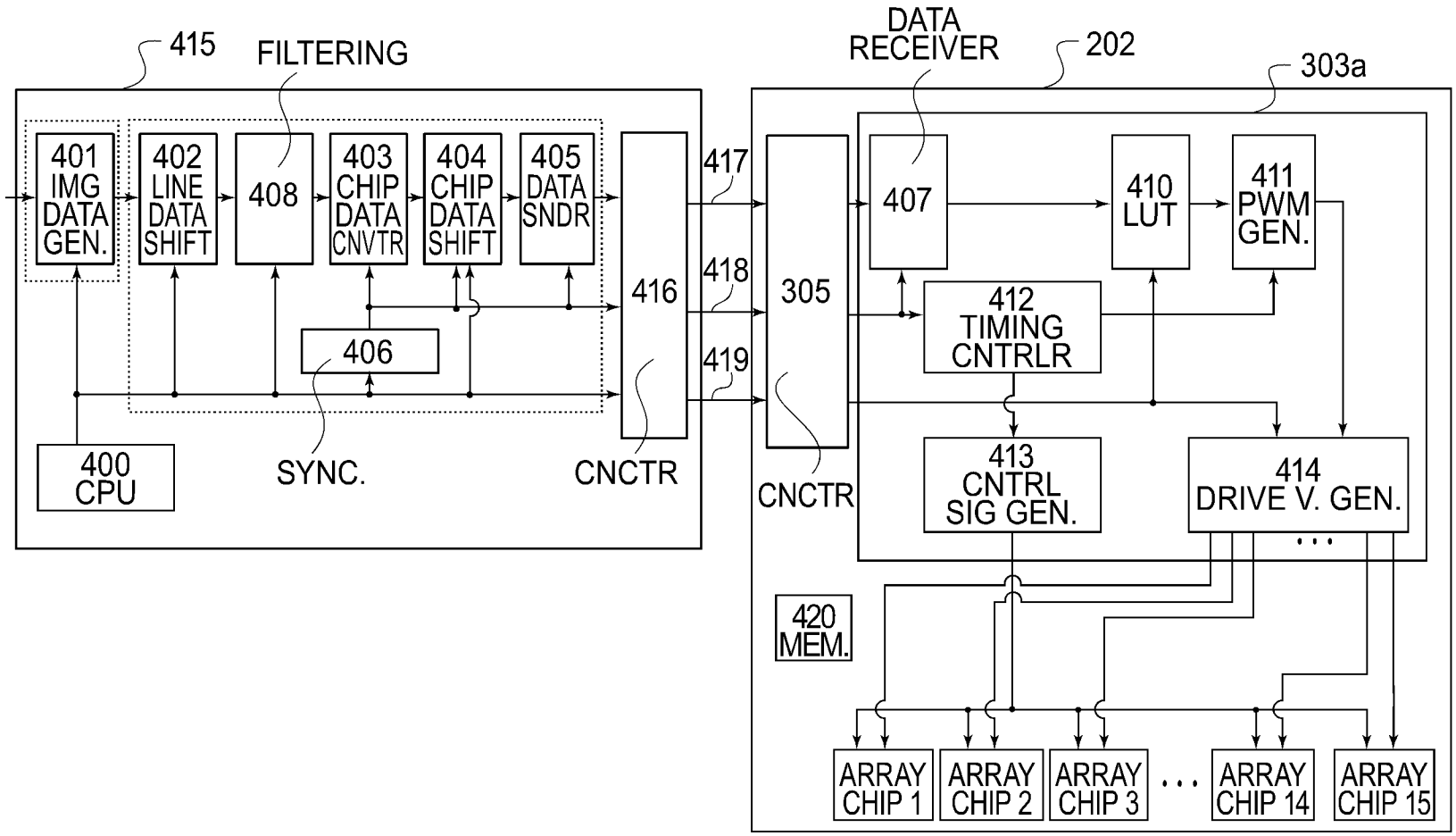

FIG. 4 is a control block diagram of an image controller and exposure head in Embodiments 1 and 2.

Figure 5:
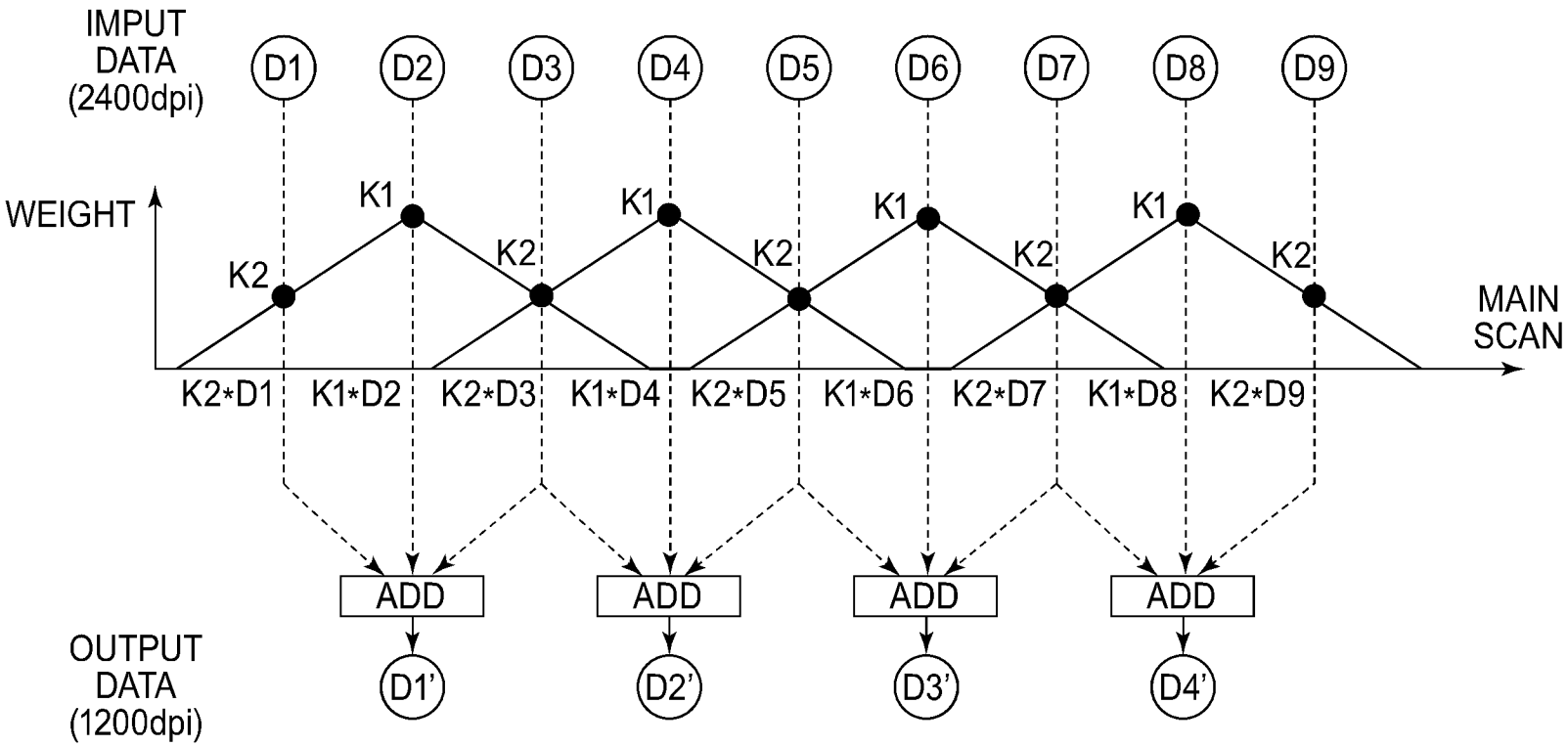

FIG. 5 is a view illustrating filter processing of Embodiments 1 and 2.

Figure 6:
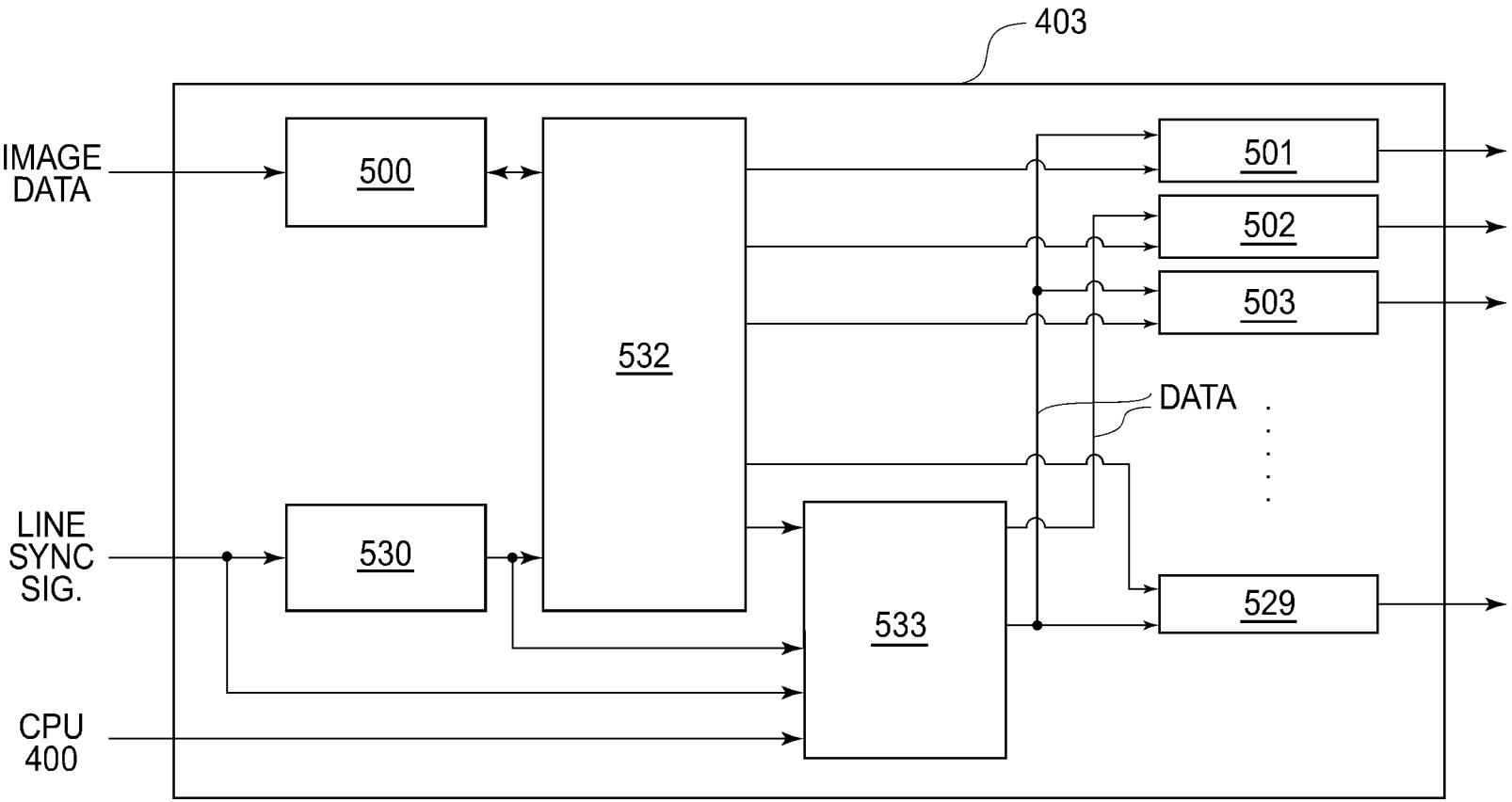

FIG. 6 is a control block diagram of a chip data converter in Embodiments 1 and 2.

Figure 7:
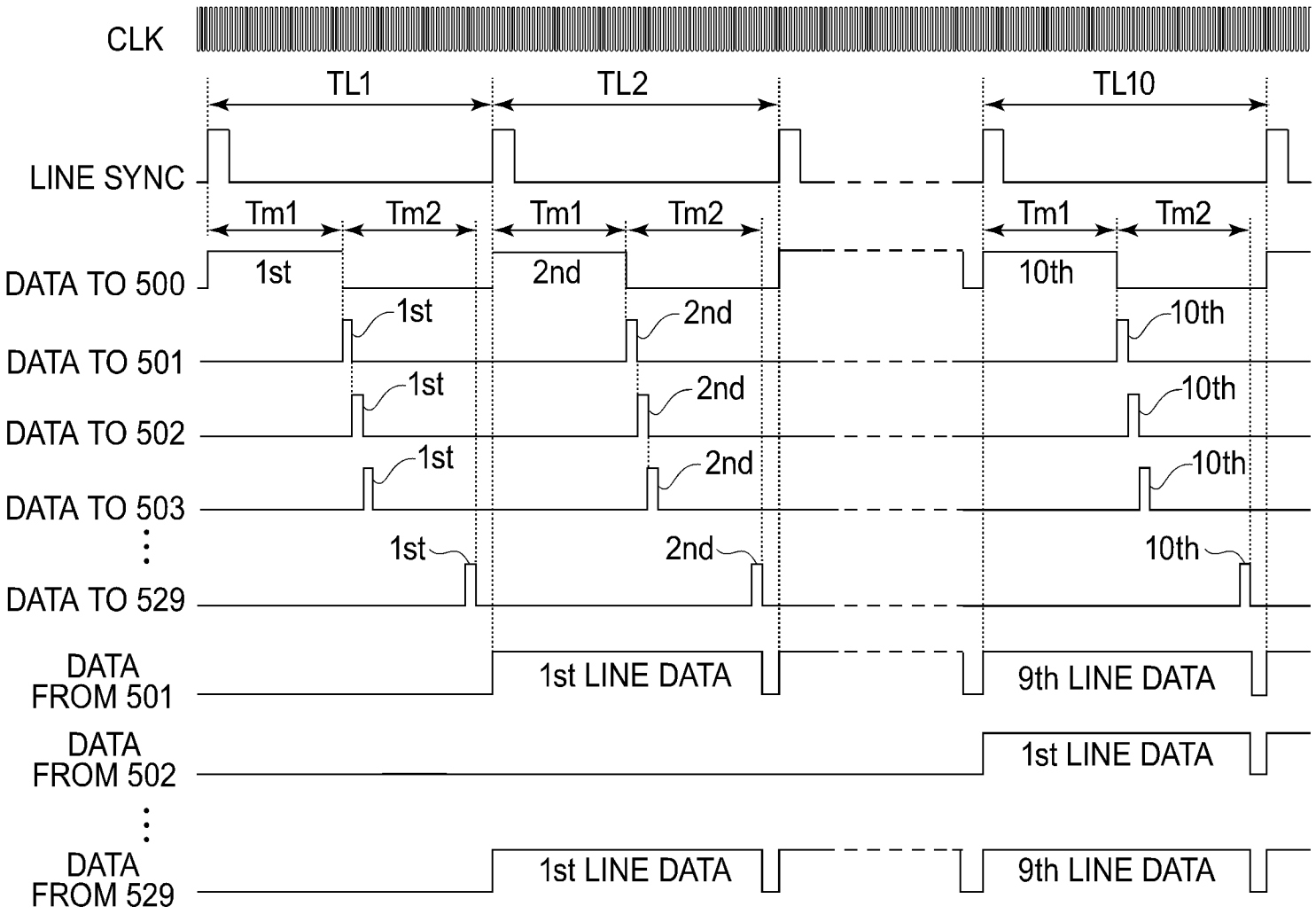

FIG. 7 is a timing chart of the chip data converter in Embodiments 1 and 2.

Parts (a), (b) and (c) of FIG. 8 show conversion tables as an example of the look-up table in Embodiment 1.

Figure 9:
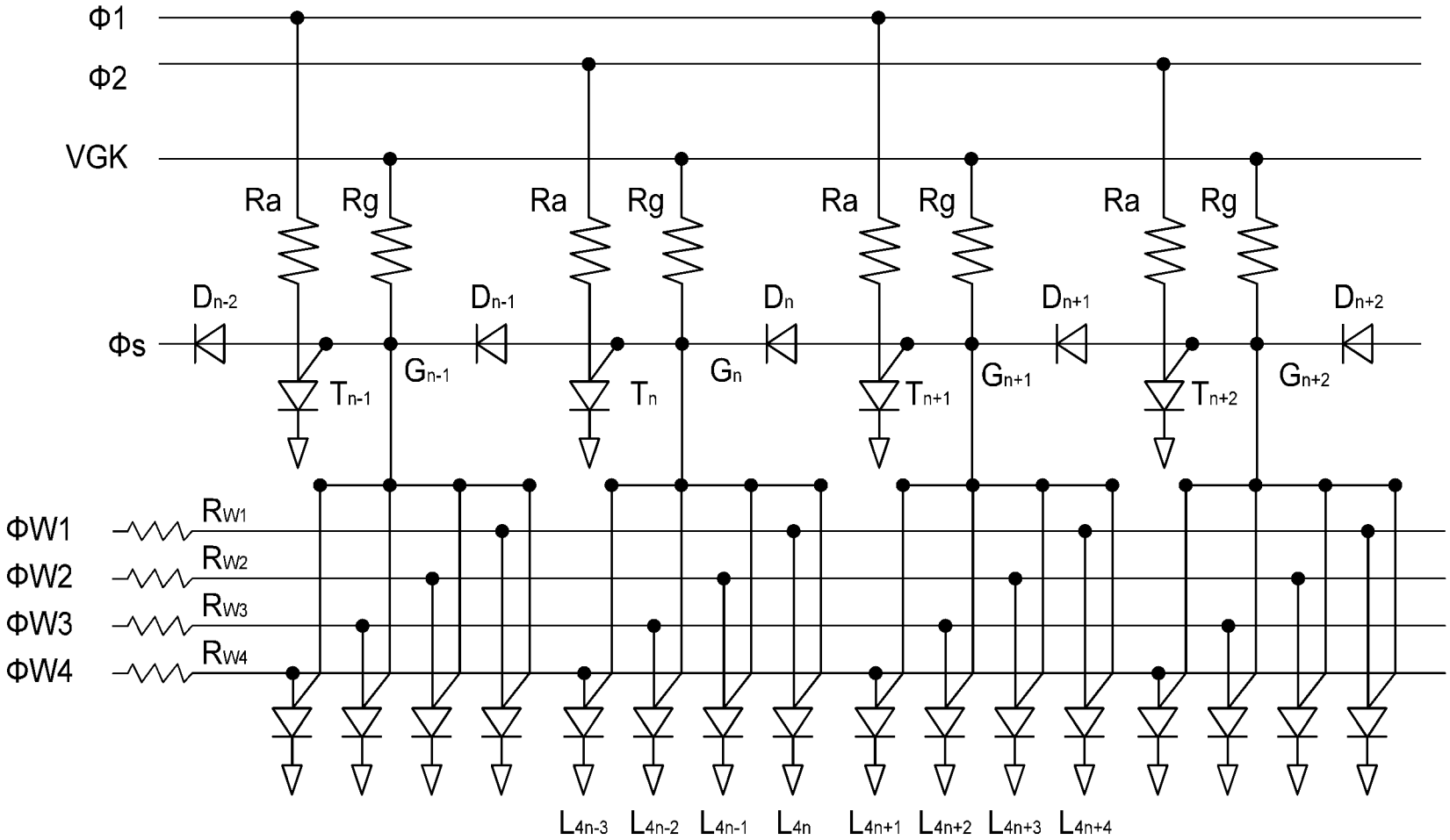

FIG. 9 is a view illustrating a circuit of the light emitting element array chip of Embodiments 1 and 2.

Figure 10:
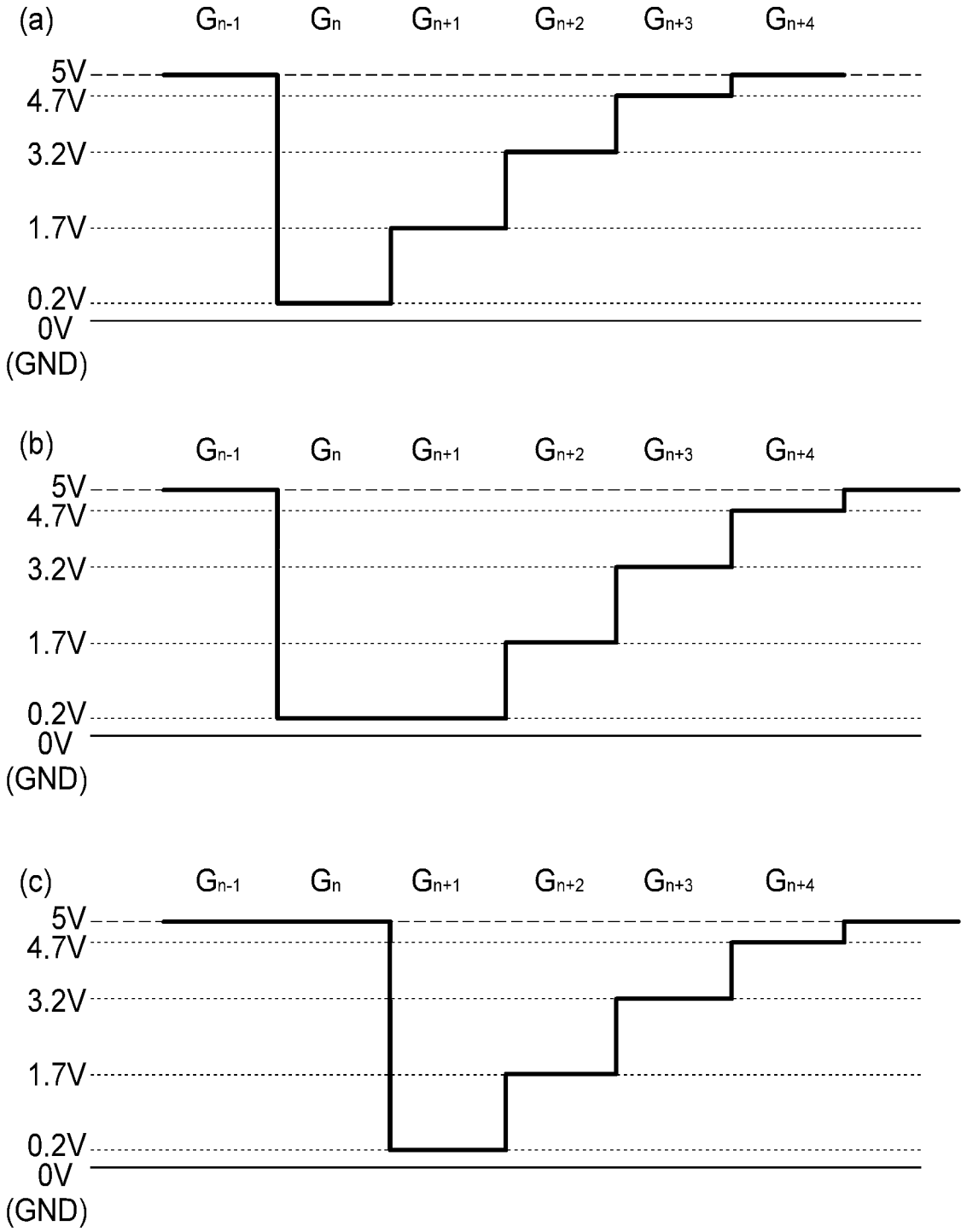

Parts (a), (b) and (c) of FIG. 10 are views illustrating the gate potential distribution of the shift thyristors in Embodiments 1 and 2.

Figure 11:
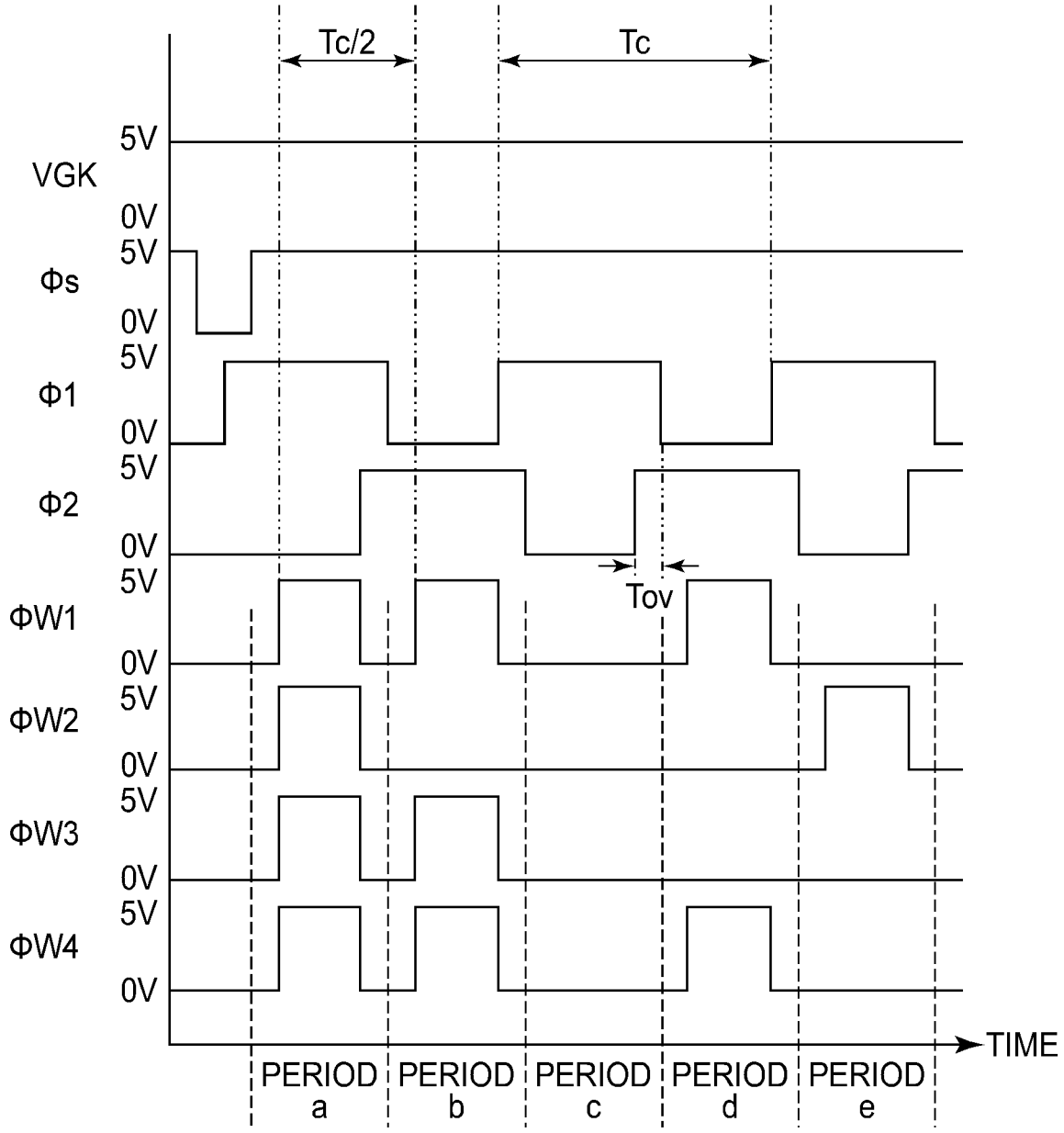

FIG. 11 shows drive signal waveforms of the light-emitting element array chips in Embodiments 1 and 2.

Figure 12:
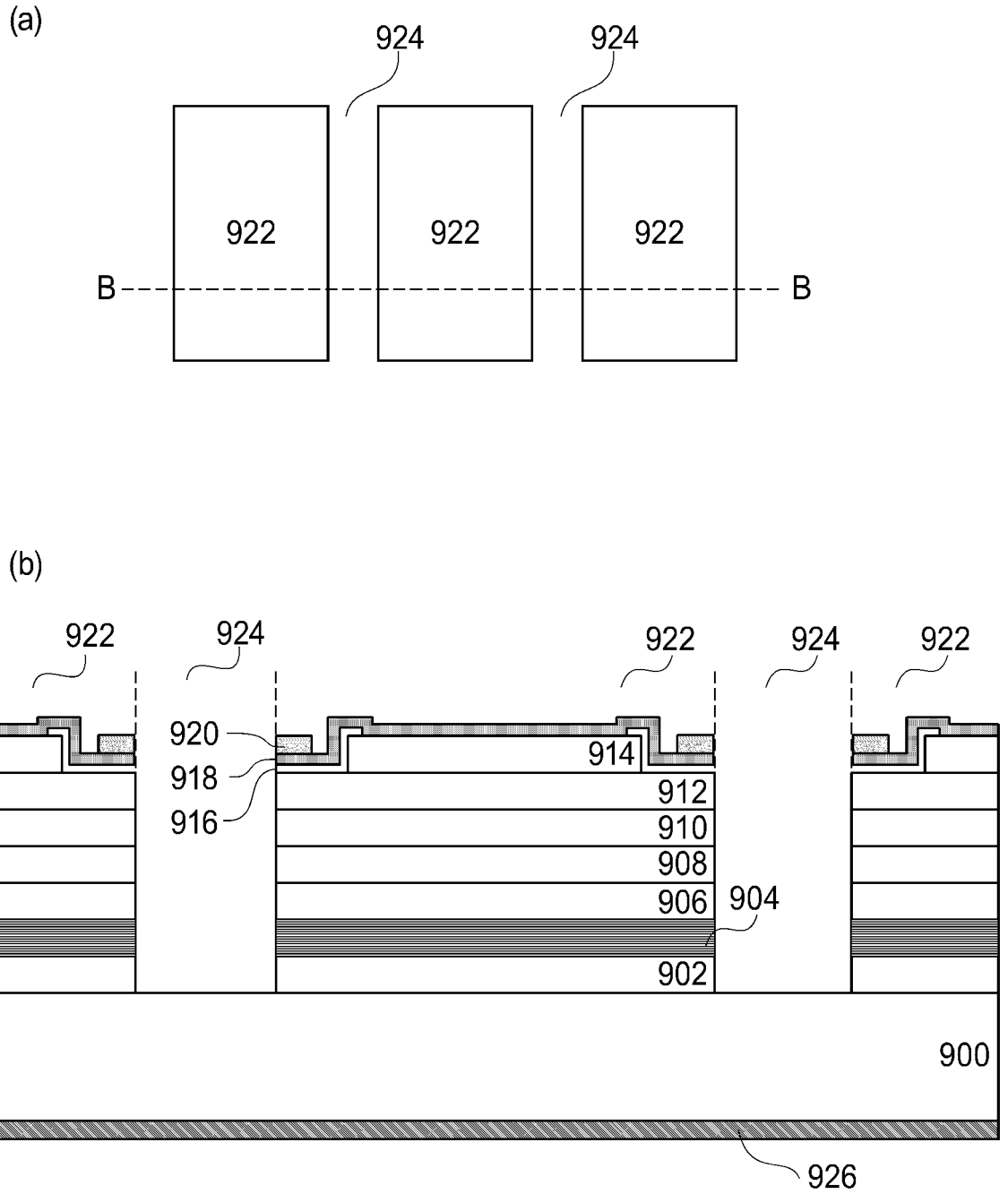

Parts (a) and (b) of FIG. 12 are cross-sectional views of a surface emitting thyristor of Embodiments 1 and 2.

Figure 13:
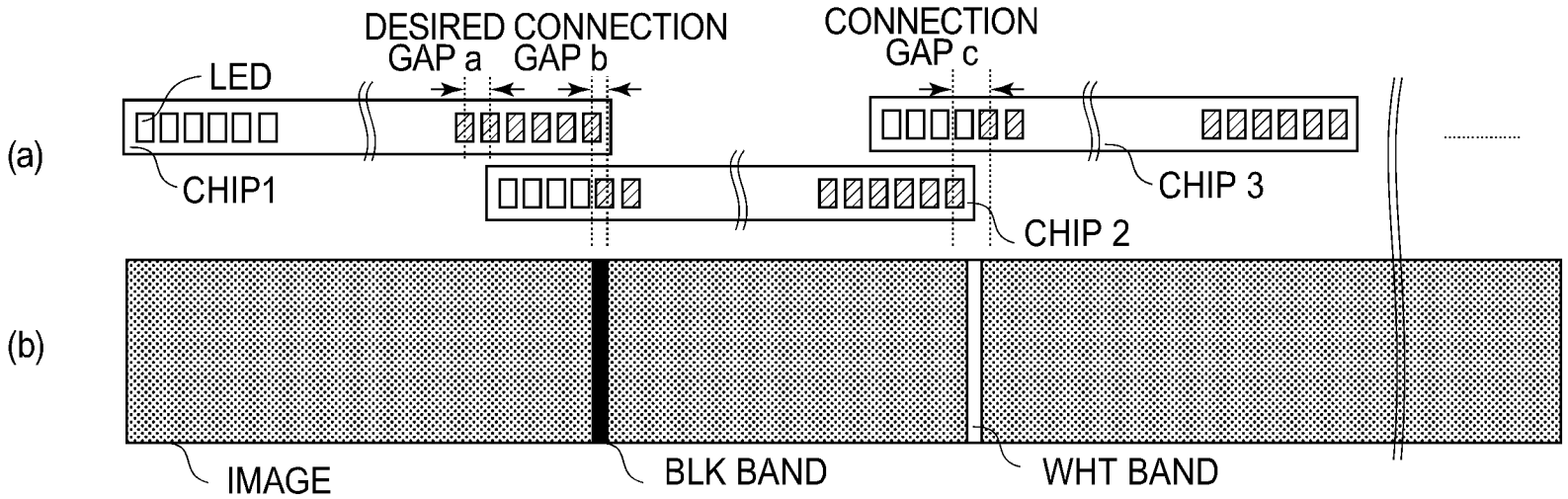

Parts (a) and (b) of FIG. 13 are views illustrating a relationship between the structure of overlapping portions of the light emitting elements in Embodiments 1 and 2 and the formed image.

Figure 14:
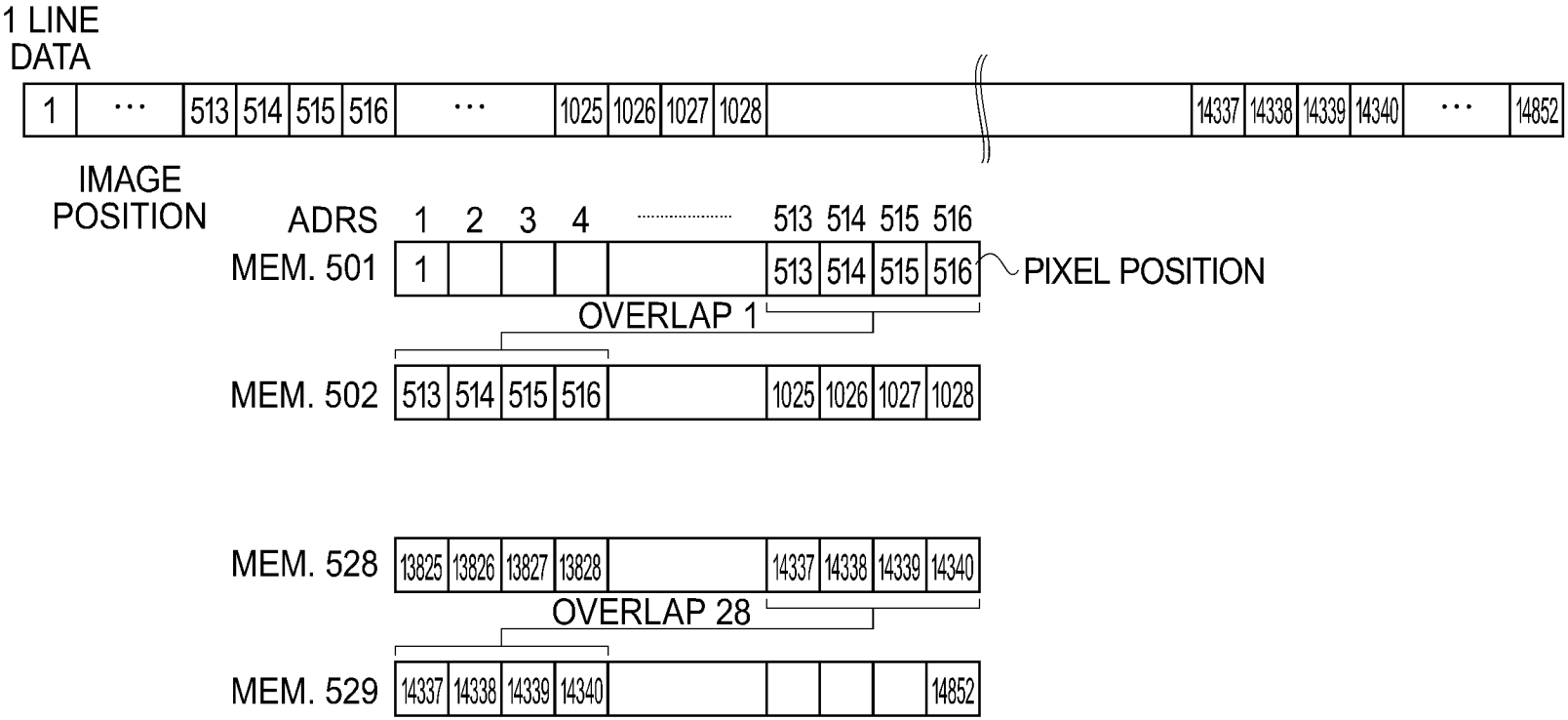

FIG. 14 is a view illustrating a storage of duplicated image data in the memory in Embodiments 1 and 2.

FIG. 15 shows an overlapping pixel selection pattern in Embodiment 1.

Figure 16:
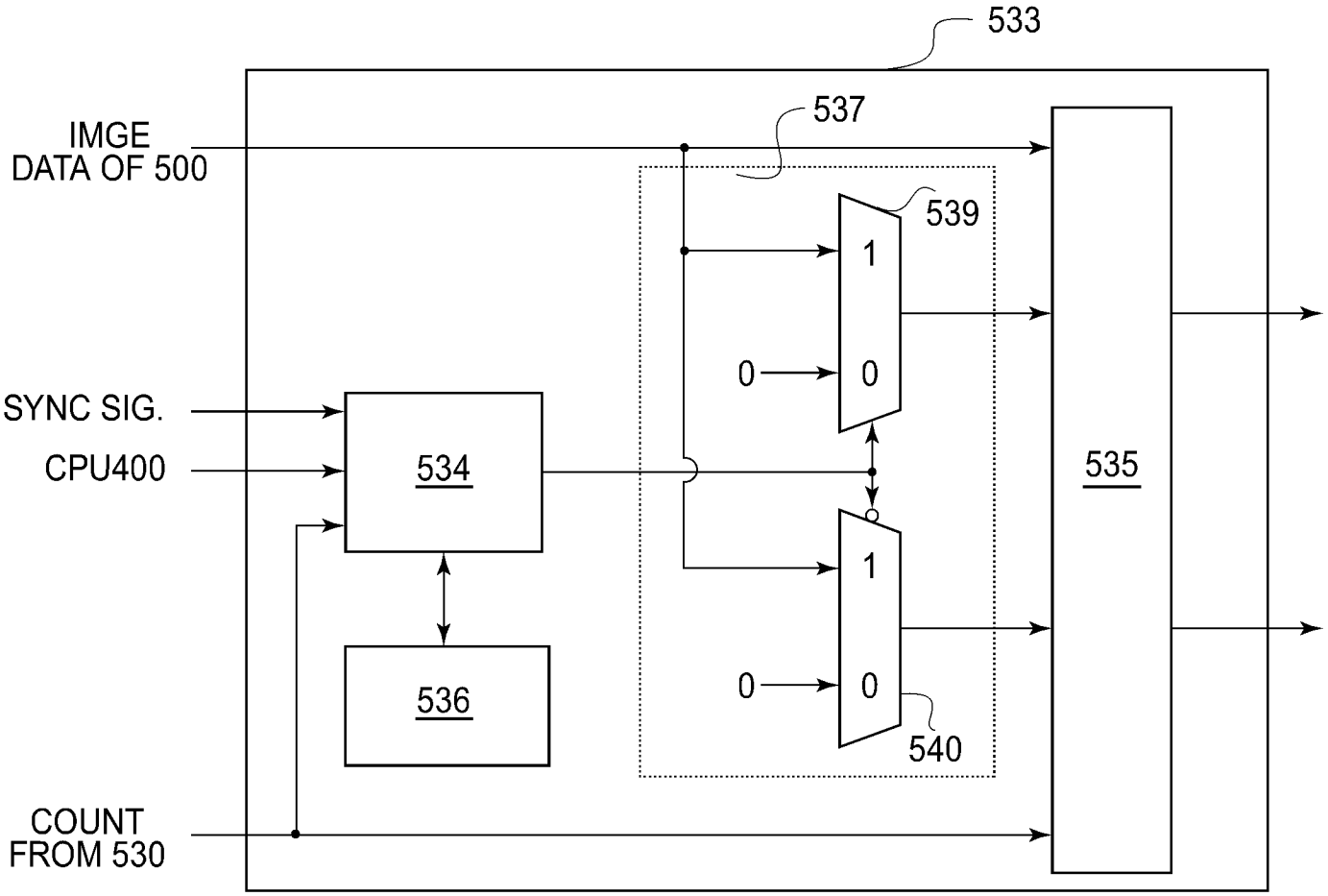

FIG. 16 is a block diagram showing a structure of the duplicate controller in Embodiment 1.

Figure 17:
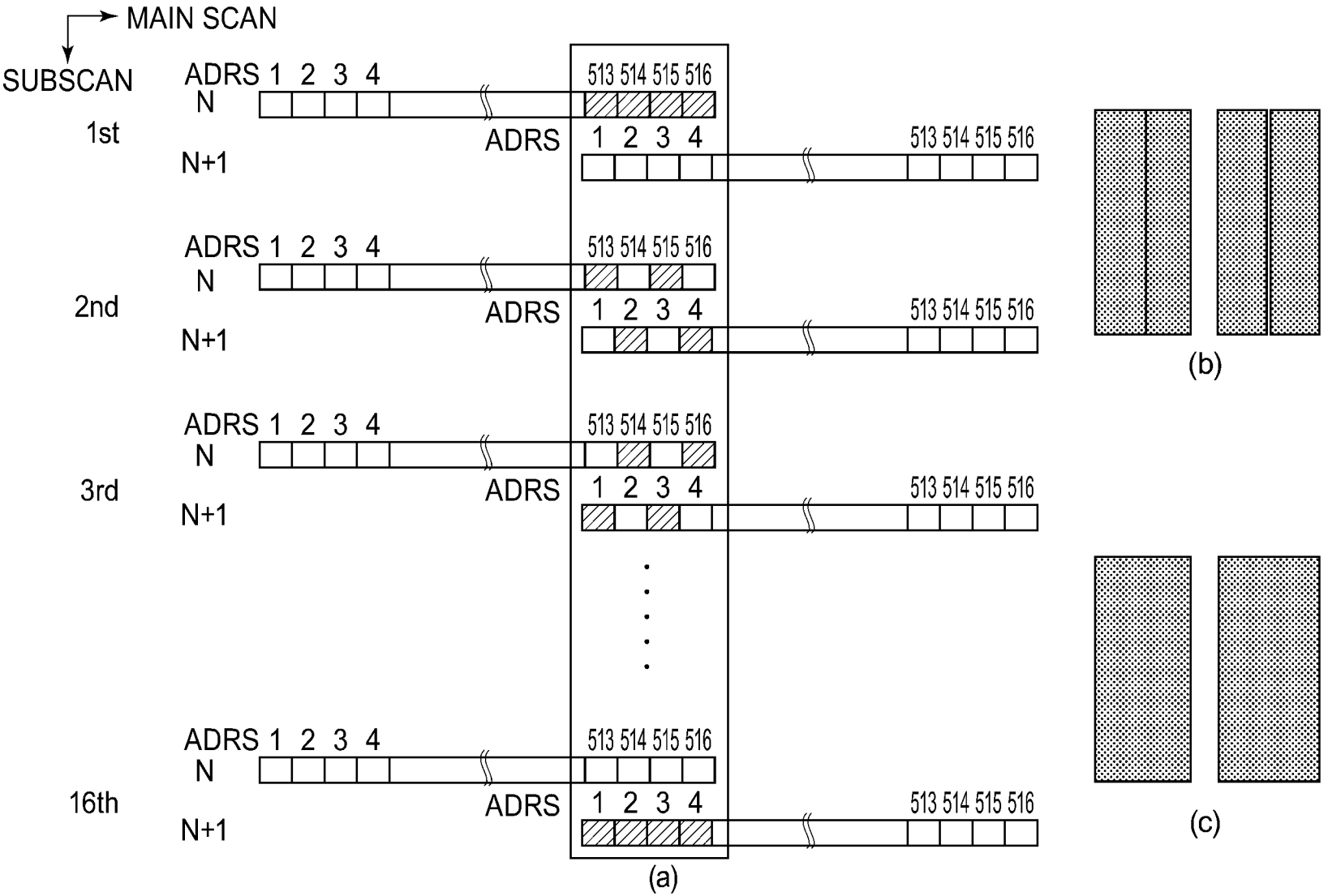

FIG. 17 is a view illustrating said effect of the duplication controller in Embodiment 1.

Figure 18:
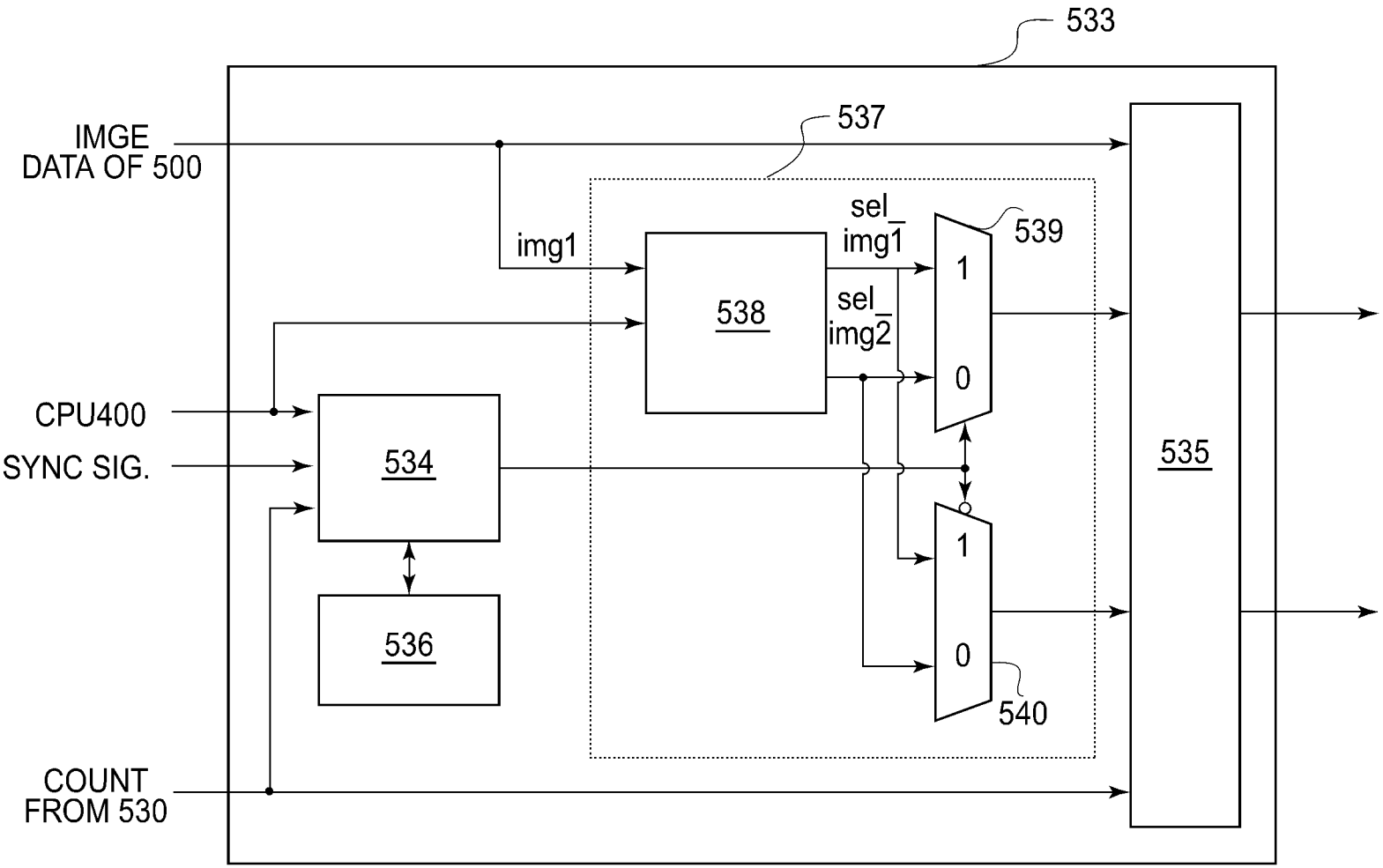

FIG. 18 is a block diagram showing the structure of the duplication controller in Example 2.

Figure 19:
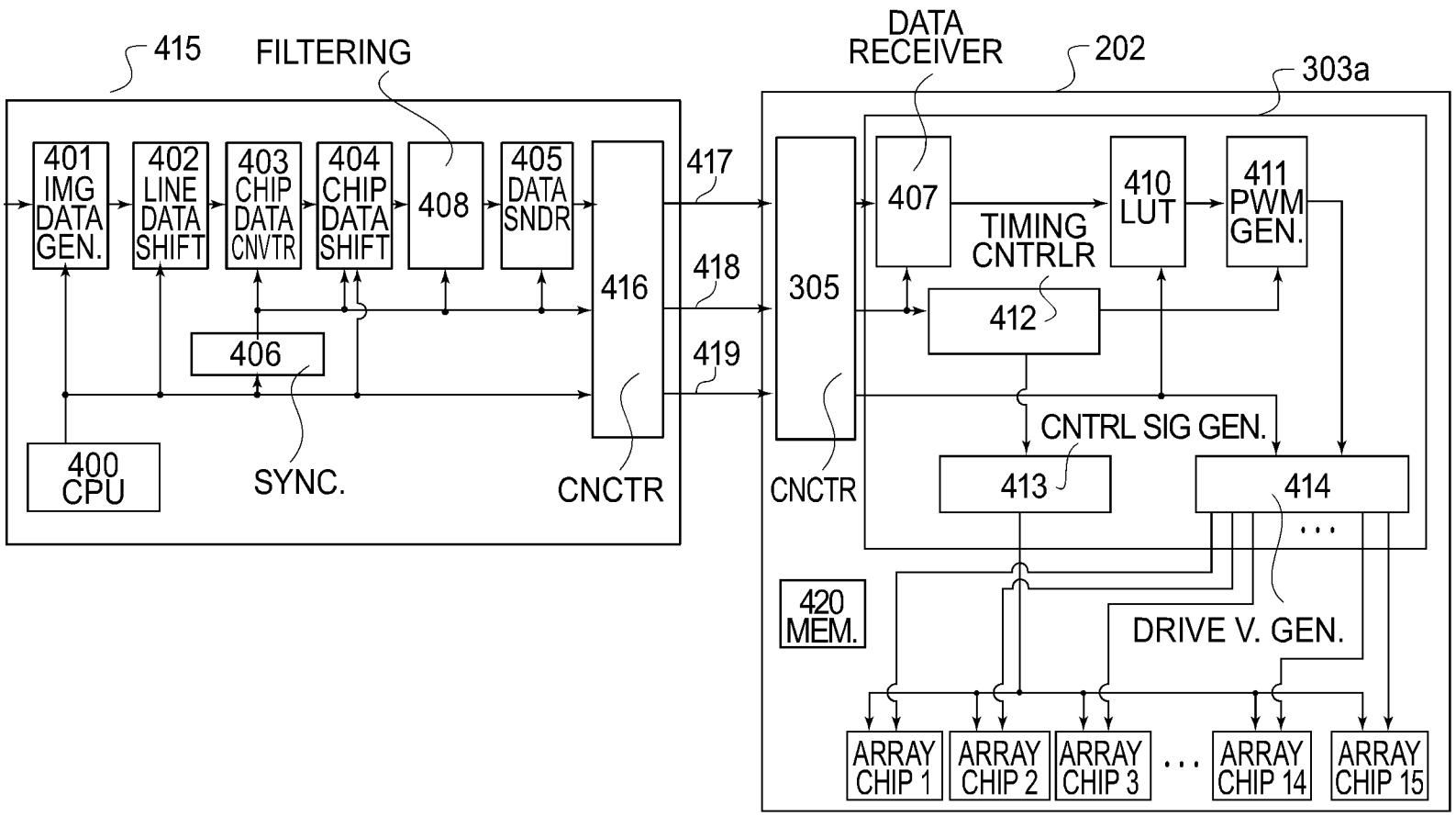

FIG. 19 is a control block the drum of the control board and drive base board in another embodiment.

DESCRIPTION OF THE EMBODIMENTS

In the following, embodiments of the present invention will be described in detail with reference to the drawings.

Embodiment

[Structure of Image Forming Apparatus]

Figure 1:
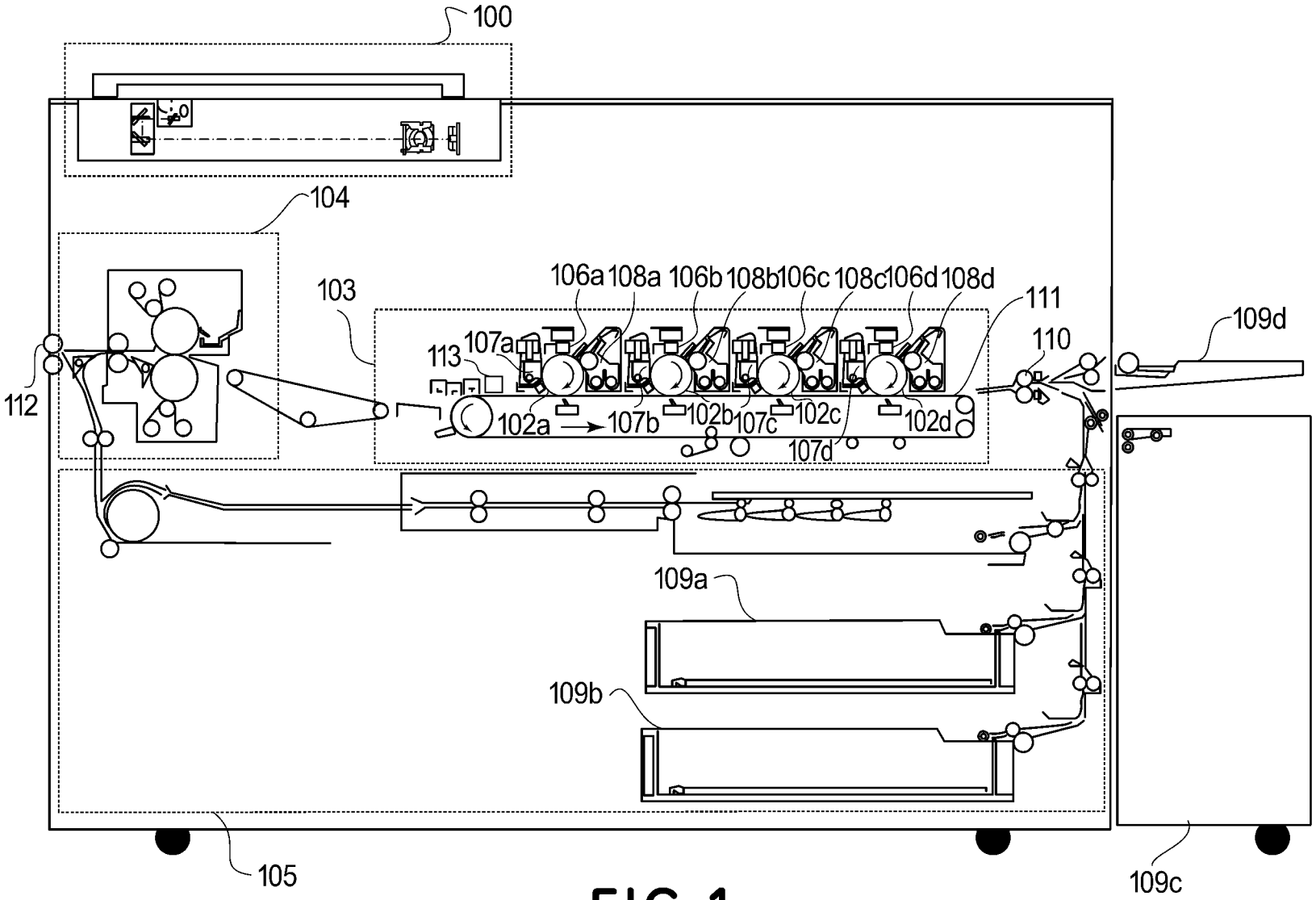
FIG. 1 is a schematic cross-sectional view illustrating the structure of the image forming apparatus of Embodiments 1 and 2.

FIG. 1 is a schematic cross-sectional view illustrating a structure of an electrophotographic image forming apparatus according to Embodiment 1. The image forming apparatus shown in FIG. 1 is a multifunction peripheral (MFP) including a scanner function and a printer function, and includes a scanner portion 100, an image forming portion 103, a fixing portion 104, the sheet feeding portion 105, and a printer controller (not shown). The scanner portion 100 illuminates an original placed on an original table, optically reads the original image, and converts the read image into an electrical signal to create image data.

The image forming portion 103 includes four image forming stations arranged along the rotational direction (counterclockwise direction) of an endless conveyance belt 111 in the order of cyan (C) image forming station, magenta (M) image forming station, yellow (Y) image forming station, and black (K) image forming station. The four image forming stations have the same structure, and each image forming station includes a photosensitive drum 102 which are photosensitive members rotatable rotate in a direction of an arrow (clockwise), an exposure head 106, a charging device 107, and a developing device 108. Here, the subscripts a, b, c, and d of the photosensitive drum 102, the exposure head 106, the charging device 107, and the developing portion 108 indicates that they are for black (K) yellow (Y), magenta (M), and cyan (C) image forming stations, respectively. Here, in the following, the suffixes are omitted except when referring to specific photosensitive drum or the like.

In the image forming portion 103, the photosensitive drum 102 is driven to rotate, and the photosensitive drum 102 is charged by the charging device 107. The exposure head 106, which is the exposure portion, emits light from the arranged light emitting element array chip according to the image data, and the light emitted from a surface of the light emitting array chip is collected on the photosensitive drum 102 (on the photosensitive member) by the rod lens array, so that an electrostatic latent image is formed. The developing device 108 develops the electrostatic latent image formed on the photosensitive drum 102 by depositing toner on the latent image. And, the developed toner image is transferred onto a recording sheet on a conveyance belt 111 which conveys the recording sheet. A series of such electrophotographic processes are executed at each image forming station. Here, during image formation, after a predetermined time has elapsed since image formation at the cyan (C) image forming station is started, image forming operations are executed sequentially at the magenta (M), yellow (Y), and black (K) image forming stations.

The image forming apparatus shown in FIG. 1 is provided with internal sheet feeding units 109*a* and 109*b* included in the sheet feeding portion 105 as units for feeding recording sheet, an external sheet feeding unit 109*c* which is a large capacity sheet feeding unit, and a manual sheet feed unit 109*d*.

During the image forming operation, recording sheet is fed from a sheet feeding portion designated in advance, and the fed recording sheet is fed to the registration roller 110. The registration roller 110 feeds the recording sheet to the feeding belt 111 at such a timing that the toner image formed in the image forming portion 103 is transferred onto the recording sheet. The toner images formed on the photosensitive drum 102 of the respective image forming stations are sequentially transferred onto the recording sheet fed by the feeding belt 111. The recording sheet on which the toner image (unfixed) has been transferred is fed to the fixing portion 104. The fixing portion 104 has a built-in heat source such as a halogen heater, and fixes the toner image on the recording sheet by heating and pressing with two rollers. The recording sheet on which the toner image is fixed by the fixing portion 104 is discharged to the outside of the image forming apparatus by the discharge roller 112.

On the downstream side of the black (K) image forming station in the recording sheet conveyance direction, an optical sensor 113 functioning as a detection portion is disposed at a position facing the conveyance belt 111. The optical sensor 113 detects the position of the test image formed on the conveyor belt 111 to determine the color misregistration amount of the toner image between each image forming station. The amount of color deviation detected by the optical sensor 113 is notified to a control board 415 (FIG. 5) which will be described hereinafter, and the image position of each color is corrected so that a full color toner image without color misregistration is transferred onto the recording sheet. In addition, in response to an instruction from the MFP controller (not shown) which controls the entire MFP (MFP), a printer controller (not shown) executes an image forming operation while controlling the above-described scanner portion 100, image forming portion 103, fixing portion 104, sheet feeding portion 105, and the like.

Here, as an example of an electrophotographic image forming apparatus, an image forming apparatus which directly transfers a toner image formed on the photosensitive drum 102 of each image forming station onto a recording sheet on the conveyance belt 111 has been described. The present invention is not limited to a printer which transfers the toner image from the photosensitive drum 102 directly onto the recording sheet. For example, the present invention can also be applied to an image forming apparatus including a primary transfer portion which transfers a toner image from the photosensitive drum 102 onto an intermediary transfer belt and a secondary transfer portion which transfers the toner image from the intermediary transfer belt onto the recording sheet.

[Structure of Exposure Head]

Next, for the exposure head 106 which exposes the photosensitive drum 102 will be explained referring to parts (a) and (b) of FIG. 2. Part (a) of FIG. 2 is a perspective view illustrating a positional relationship between the exposure head 106 and the photosensitive drum 102, and part (b) of FIG. 2 is a view illustrating an internal structure of the exposure head 106 and showing how the light beam from the exposure head 106 is condensed on the photosensitive drum 102 by the rod lens array 203. As shown in part (a) of FIG. 2, the exposure head 106 is mounted to the image forming apparatus by a mounting member (not shown) at a position facing the photosensitive drum 102 rotatable in a direction of an arrow (FIG. 1).

As shown in part (b) of FIG. 2, the exposure head 106 includes a drive substrate 202 (an example of a substrate), a light-emitting-element array element group 201 mounted on the drive substrate 202, a rod lens array 203, and a casing 204. The rod lens array 203 and the drive substrate 202 are mounted to the casing 204. The rod lens array 203 condenses the light flux from the light-emitting-element array element group 201 on the photosensitive drum 102. At the factory, the exposure head 106 is assembled and adjusted by itself, and the focus and light intensity of each spot are adjusted. Here, the assembling and adjustment is performed such that a distance between the photosensitive drum 102 and the rod lens array 203 and a distance between the rod lens array 203 and the light-emitting-element array element group 201 are predetermined distances. By this, the light from the light-emitting-element array element group 201 is imaged on the photosensitive drum 102. Therefore, at the time of focus adjustment at the factory, the mounting position of the rod lens array 203 is adjusted so that the distance between the rod lens array 203 and the light-emitting-element array element group 201 is a predetermined value. In addition, when adjusting the light intensity at the factory, each surface light emitting element of the light-emitting-element array element group 201 is caused to emit light sequentially, and the drive current of each light emitting element is adjusted so that the light condensed on the photosensitive drum 102 via the rod lens array 203 has a predetermined light intensity.

In this embodiment, each light emitting element is a semiconductor LED which is a light emitting diode. However, each light emitting element is not limited to a LED, and may be, for example, an OLED (Organic Light Emitting Diode). This OLED, also called organic EL (Organic Electro-Luminescence), is a current-driven type light-emitting element. The OLEDs are arranged on a line along the main scanning direction (rotational axis direction of the photosensitive drum 102) on a TFT (Thin Film Transister) substrate, for example, and are electrically connected to the power supply wiring provided along the main scanning direction, electrically in parallel. Here, the OLED as a plurality of light emitting elements may be constituted by dividing an organic material into a plurality of light emitting sections of predetermined sizes. In this case, one light-emitting area divided into a lattice corresponds to one element OLED.

[Structure of Light-Emitting-Element Array Element Group]

Parts (a), (b) and (c) of FIG. 3 illustrate the surface-light-emitting-element array element group 201. Part (a) of FIG. 3 is a schematic illustration showing the structure of the surface (mount surface) on which the light-emitting-element array element group 201 of the driving substrate 202 is mounted, part (b) of FIG. 3 is a schematic illustration showing the structure of the surface (opposite surface) opposite to the mount surface on which the light-emitting-element array element group 201 of the drive substrate 202 is mounted.

As shown in part (a) of FIG. 3, the surface emitting element array element group 201 mounted on the driving substrate 202 has a structure in which 29 surface emitting element array chips 1 to 29 are arranged in two rows in a staggered manner along the longitudinal direction of the driving substrate 202. Here, in part (a) of FIG. 4, the vertical direction indicates the first direction, which is the sub-scanning direction (the peripheral moving direction of rotation of the photosensitive drum 102), and the horizontal direction is the second direction perpendicular to the sub-scanning direction. Inside each surface light emitting element array chip, each element of the surface light emitting element array chip including a total of 516 light emitting points is linearly arranged at a predetermined resolution pitch in the longitudinal direction of the surface light emitting element array chip. Each surface emitting element array In this embodiment, the pitch of each element of the surface emitting element array chip is approximately 21.16 μm (≈2.54 cm/1200 dots), which means a resolution of 1200 dpi, and which is the first resolution. As a result, the distance from end to end of 516 light emitting points in one surface light emitting element array chip is about 10.9 mm (≈21.16 μm×516). The light-emitting-element array element group 201 comprises 29 surface light emitting element array chips. The number of light emitting elements which can be exposed in the light-emitting-element array element group 201 is 14,964 elements (=516 elements×29 chips).

On the driving substrate 202 of this embodiment, the light emitting element array chips 1 to 29 are arranged in a staggered pattern. That is, in the main scanning direction in which the photosensitive drum 102 is scanned, the upper and lower rows of the elements are alternately arranged in the rotating direction of the photosensitive drum 102. Furthermore, the light emitting element array chips adjacent to the photosensitive drum 102 in the sub-scanning direction are arranged as follows. Here, in this embodiment, the sub-scanning direction is a direction perpendicular to the main scanning direction and is the same as the width direction of the substrate 202. Among the light emitting elements inside the light emitting element array chip adjacent in the sub-scanning direction, one or more light emitting elements arranged at the end are disposed at a position overlapping the end light emitting element of the adjacent light emitting element array chip in the rotational direction of the photosensitive drum. In other words, when looking at the mounting surface along the direction perpendicular to the mounting surface of the driving substrate 202, one area of one light emitting element array chip (first chip) of the two light emitting element array chips and one area of the other light emitting element array chip (second chip) are aligned in the width direction of the drive substrate 202. A plurality of light emitting elements are provided in the above-described one area. Therefore, a light emitting element included in one light emitting element array chip and a light emitting element included in the other light emitting element array chip are aligned in the width direction of the substrate.

More specifically, as shown in part (c) of FIG. 3, in this embodiment, four light emitting elements at the end of the light emitting element array chip are arranged at positions overlapping with four light emitting elements at the end of the adjacent light emitting element array chip arranged in a staggered manner. Therefore, in the case of a structure in which four light emitting elements are overlapped between the adjacent light emitting element array chips, image formation corresponding to the image width in the main scanning direction of about 314 mm (≈about 21.16 μm×14852 (=14964−(4×28))) is possible. In this case, the area where four light emitting elements are provided on the light emitting element array chip corresponds to the above-described one area. Here, in the embodiment in which the positions of the light emitting elements, at the end portions, of the light emitting element array chips arranged in a staggered manner adjacent to each other in the sub-scanning direction. For example, even if the position of the light emitting element at the end of each light emitting element array chip is deviated, it is possible to use this embodiment if the light emitting region formed by one or more light emitting elements at the end overlaps between the light emitting element array chips.

Part (c) of FIG. 3 is an illustration showing a state of a boundary portion between the chips of the surface emitting element array chips arranged in two rows in the longitudinal direction, the horizontal direction is the longitudinal direction of the light-emitting-element array element group 201 in part (a) of FIG. 3. As shown in part (c) of FIG. 3, at the end of the surface emitting element array chip, there is provided a wire bonding pad ("WB pad") to which a control signal is inputted, and a transfer portion and the light emitting element are driven by the signal fed from the wire bonding pad. In addition, the surface light emitting element array chip has a plurality of light emitting elements. At the boundary between the surface light emitting element array chips, the pitch of the light emitting elements in the longitudinal direction (the distance between the center point of the adjacent two light emitting elements) is approximately 21.16 μm, which is a 1200 dpi resolution pitch. In addition, the surface emitting element array chips arranged in two upper and lower rows are placed such that a light emitting point interval (indicated by an arrow S in the Figure) of the upper and lower surface emitting element array chips is approx. 84 μm (distance of integer multiple of the resolution, that is, 4 pixels at 1200 dpi, 8 pixels at 2400 dpi).

As shown in part (b) of FIG. 3, drive portions 303*a* and 303*b* and a connector 305 are mounted on the surface of the drive substrate 202 opposite to the surface on which the light-emitting-element array element group 201 is provided. The drivers 303*a* and 303*b* arranged on the respective sides of the connector 305 is a drive IC for driving the surface light emitting element array chips 1 to 15 and the surface light emitting element array chips 16 to 29, respectively. The drive portions 303*a* and 303*b* are connected to the connector 305 via patterns 304*a* and 304*b*, respectively. Connector 305 is connected to signal lines, power supply voltage, and ground for controlling drive portions 303*a* and 303*b* from control board 415 (FIG. 4), which will be described hereinafter, thus it is connected to drive portions 303*a* and 303*b*. In addition, from the drive portions 303*a* and 303*b*, a wiring for driving the light-emitting-element array element group 201 passes through an inner layer of the driving substrate 202 and is connected to the surface light emitting element array chips 1 to 15 and the surface light emitting element array chips 16 to 29.

[Control Board and Drive Board Control Structure]

FIG. 4 shows a control substrate 415 which processes image data and outputs the processed data to the drive substrate 202 of the exposure head 106, and a drive substrate of the exposure head 106 which exposes the photosensitive drum 102 based on the image data inputted from the control substrate 415. As for the driving substrate 202, the surface emitting element array chips 1 to 15 controlled by the driving portion 303*a* shown in FIG. 4 will be described. Here, the surface emitting element array chips 16 to 29 controlled by the driving portion 303*b* (not shown in FIG. 4) also carry out the same operation as the surface emitting element array chips 1 to 15 controlled by the driving portion 303*a*. To simplify the explanation, the explanation will be made as to the image processing for one color here, although in the image forming apparatus of this embodiment, the same processing is carried out simultaneously in four colors. A control board 415 shown in FIG. 4 has a connector 416 for transmitting a signal for controlling the exposure head 106 to the drive board 202. From the connector 416, the image data, the line synchronization signal which will be described hereinafter, and the control signal from the CPU 400 of the control board 415 is transmitted, through the cables 417, 418, and 419 connected to the connector 305 of the drive board 202, respectively.

[Structure of Control Board]

In the control board 415, the CPU 400 performs image data processing and print timing processing. The control board 415 includes functional blocks of image data generation portion 401, a line data shift portion 402, a filtering process portion 408, a chip data conversion portion 403, a chip data shift portion 404, a data transmission portion 405, and a synchronization signal generation portion 406. In this embodiment, the image data generation portion 401 is constituted by in one integrated circuit (IC). In addition, the line data shift portion 402, the filtering process portion 408, the chip data conversion portion 403, the chip data shift portion 404, the data transmission portion 405, and the synchronization signal generation portion 406 are constituted by one integrated circuit (IC) different from the image data generation portion 401. Here, the image data generation portion 401, the line data shift portion 402, the filtering process portion 408, the chip data conversion portion 403, the chip data shift portion 404, the data transmission portion 405, and the synchronization signal generation portion 406 are modules inside the integrated circuit (IC). In addition, the CPU 400 is another circuit different from these integrated circuits, and the control board 415 is mounted with the CPU 400, integrated circuit including the image data generation portion 401, integrated circuit including the line data shift portion 402, and the connector 416. Here, the image data generation portion 401, the line data shift portion 402, the filtering process portion 408, the chip data conversion portion 403, the chip data shift portion 404, the data transmission portion 405, and the synchronization signal generation portion 406 may be included in one integrated circuit. Furthermore, the image data generation portion 401, the line data shift portion 402, the filtering process portion 408, the chip data conversion portion 403, the chip data shift portion 404, the data transmission portion 405, the synchronization signal generation portion 406, and the CPU 400 may be included in one integrated circuit. In the following, processing in each functional block will be described in the order in which image data on the control board 415 is processed.

(Image Data Generator)

An image data generation portion 401 functioning as a data generation means performs dithering processing on the inputted image data received from the scanner portion 100 or an external computer connected to the image forming apparatus, at a resolution instructed by the CPU 400 for print output, so that the image data is generated.

In this embodiment, the image data generator 401 performs dithering processing at a resolution of 2400 dpi, which is equivalent to the second resolution. That is, the image data generated by the image data generator 401 is pixel data equivalent to 2400 dpi. The pixel data equivalent to 2400 dpi in this example is 1 bit data, but one pixel may be expressed by a plurality of bits. The pixel data generated by the image data generator 401 is line data corresponding to a line corresponding in 2400 dpi resolution in the sub-scanning direction (the rotational direction of the photosensitive drum 102, that is, the conveyance direction of the recording sheet). And, the image data generator 401 generates pixel data corresponding to each pixel including a resolution equivalent to 2400 dpi in association with the position of the pixel in the main scanning direction (longitudinal direction of the exposure head 106)

(Line Data Shift Portion)

The CPU 400 determines the image shift amounts in the main scanning direction and the sub-scanning direction based on the color misregistration amount detected by the optical sensor 113 in 2400 dpi unit, respectively. The image shift amount is determined by the CPU 400 based on, for example, the relative color misregistration amount between colors calculated based on a detection result of the color misregistration detection pattern image by the optical sensor 113. And, the CPU 400 instructs the line data shift portion 402 functioning as correction means on the image shift amount. In the line data shift portion 402, based on the image shift amount instructed by the CPU 400, the image data (also referred to as line data) inputted from the image data generation portion 401 for the entire image area for one page of recording sheet is processed for shifting. The image formation position is corrected by the shift process. Here, the line data shift portion 402 may divide the image area for one page of the recording sheet into a plurality of parts, and execute a shift process for each of the plurality of divided image areas.

(Filtering Processing Portion)

A filter processing portion 408 functioning as a conversion means converts the resolution in the main scanning direction from 2400 dpi to 1200 dpi. In this embodiment, the image data is interpolated by filtering in the main scanning direction. FIG. 5 is a view illustrating the state of the filter processing in the filter processing portion 408. In FIG. 5, references D1 to D9 depict image data of the light emitting element array chip (input data in 2400 dpi). Here, the image data D1 to D8 are the data of the corresponding light emitting element array chip, and the image data D9 is pixel data at the extreme end of the adjacent light emitting element array chip. D1' to D4' indicate image data (1200 dpi output data) after the filter processing portion 408 performs the filter processing. The resolution of output data (1200 dpi) is half of the resolution of input data (2400 dpi), and the calculation formula of image data of each pixel is expressed by the following (Formula 1)

$$Dn'=D(2\times n-1)\times K2+D(2\times n)\times K1+D(2\times n+1)\times K2 \quad \text{(Equation 1)}$$

Here, the value of the pixel position n is 1 to 14852. When n=14852, the extreme end data D (29705 (=14852×2+1)) has no adjacent light emitting element array chip, and therefore, is processed as white (0), for example. K1 as a first coefficient is a weighting coefficient for the output data and input data at the same coordinate position in the main scanning direction. K2 which is said second coefficient is a weighting coefficient for the input data including coordinates shifted by ½ pixel in the main scanning direction with respect to the output data. In this embodiment, interpolation calculation (filter processing) is performed with values of K1=0.5 and K2=0.25, but other weighting coefficients different from those of this embodiment may be used. In this embodiment, by setting the weight coefficient K2 to a value greater than 0, information of image data generated at a resolution (2400 dpi) higher than the resolution of output data (1200 dpi) can be reflected in the output data. More specifically, in the processing up to the previous stage, image position movement in the main scanning direction is performed at 2400 dpi, and then the resolution of the image data is converted to 1200 dpi by the filter processing portion 408. By this, it is possible to generate 1200 dpi images while maintaining image movement accuracy in 2400 dpi units.

In addition, in performing the pixel processing at the end of the light emitting element array chip, using the filtering process, if there is no pixel data of the adjacent light emitting element array chip, the image is omitted with the result of occurrence of an image defect. Therefore, when processing the edge pixel data, the processing is performed by add in g pixel data on the end side of the adjacent light emitting element array chip, so that the image omission does not occur.

(Synchronization Signal Generator)

The synchronization signal generator 406 generates a signal synchronized with the rotation speed of the photosensitive drum 102, and more particularly it generates a periodic signal for one line (hereinafter referred to as a "Line synchronization signal") along the rotation axis direction of the photosensitive drum 102. The CPU 400 instructs the synchronization signal generator 406 to determine the period of the Line synchronization signal, that is, the time required for the photosensitive drum 102 surface to move 2400 dpi pixel size (about 10.5 μm) in the rotational direction (sub-scanning direction) for a predetermined rotational speed of the photosensitive drum 102. For example, when printing at a speed of 200 mm/sec in the sub-scanning direction, the CPU 400 instructs the synchronization signal generator 406 to set the period of the line synchronization signal (period for one line in the sub-scanning direction) to about 52.9 μs (25.4 mm/2400 dots)/200 mm).

When the image forming apparatus includes a detection portion that detects the rotation speed of the photosensitive drum 102, the CPU 400 detects the photosensitive drum speed in the sub-scanning direction is calculated based on the detection result of the detection portion (the generation period of the signal output from the encoder). And, the CPU 400 determines the cycle of the line synchronization signal based on the calculation result. Here, the detector is an encoder provided on the rotating shaft of the photosensitive drum, for example. On the other hand, when the image forming apparatus is not provided with a detection portion which detects the rotation speed of the photosensitive drum 102, the rotation speed of the photosensitive drum 102 is calculated based on the following information. That is, the CPU 400 determines the cycle of the line synchronization signal based on the paper type information such as the sheet basis weight (g/cm$^2$) and the sheet size inputted on the operation portion by the user.

(Chip Data Converter)

The chip data conversion portion 403 reads line data for each line in the sub-scanning direction of the photosensitive drum 102 from the filtering process portion 408 in synchronism with the line synchronization signal. And, the chip data conversion portion 403 executes data processing for dividing the read line data into line data for each chip, and stores the data in the memories 501 to 529 corresponding to the respective surface light emitting element array chips 1 to 29.

FIG. 6 is a block diagram showing a structure of the chip data conversion portion 403. In FIG. 6, the line synchronization signal outputted from the synchronization signal generation portion 406 is inputted to the counter 530.

The counter 530 includes a frequency modulation circuit that modulates an input line synchronization signal to generate a clock signal (CLK) having a frequency higher than that of the line synchronization signal. The counter 530 may include an oscillator which generates a clock signal having a frequency higher than that of the line synchronization signal, in place of the frequency modulation circuit.

When the line synchronization signal is input, the counter 530 resets the count value to 0, and then increments the counter value in synchronization with the number of pulses of the clock signal (FIG. 7). The frequency of the CLK signal generated by the counter 530 depends on the pixel data capacity (number of bits) which the chip data converting portion 403 can read within one cycle of the line synchronization signal, and the data processing speed of the chip data converting portion 403, which will be described hereinafter, and the frequency is determined at the design stage. For example, the light emitting element array element group 201 has 14,852 light emitting elements (1200 dpi equivalent) which expose one line in the sub-scanning direction, as described above. On the other hand, the image data generator 401 performs dithering processing at a resolution of 2400 dpi, and the filter processing portion 408 performs interpolation processing by filtering in the main scanning direction, and converts the resolution in the main scanning direction from 2400 dpi to 1200 dpi. Therefore, the number of pixels of the image data for one line in the sub-scanning direction output from the filter processing portion 408 is 14,852 pixels.

The chip data converting portion 403 reads line data for one line in the sub-scanning direction during one Line synchronization signal, and performs writing to the line memory 500 which will be described hereinafter and writing of image data to the memories 501 to 529 which will be described hereinafter. Therefore, the counter 530 performs a counting operation (29704) which is twice the number of pixels (14852) included in one line of line data. Tm1 is the period from 1 to 14852 as the count value of the counter 530, and Tm2 is the period from 14853 to 29704 as the count value (FIG. 7) The memory controller 532 reads the line data from the filter processing portion 408 in accordance with the count value of the counter 530. That is, the READ controller 531 stores the line data (14852 pixels) for one line in the main scanning direction in the line memory 500 during a period Tm1 in which the count value of the counter 530 is 1 to 14,852. In addition, the memory controller 532 divides and writes the line data for one line in the sub-scanning direction stored in the line memory 500 into the memories 501 to 529 during the period Tm2 when the count value of the counter 530 is 14,853 to 29,704.

Memories 501 to 529 have a smaller storage capacity than the line memory 500, and store line data (divided line data) divided for each chip. Here, the memories 501 to 529 are FIFO (First In First Out) memories provided corresponding to the light emitting element array chips 1 to 29. That is, the memory 501 stores line data corresponding to the light emitting element array chip 1, the memory 502 stores line data corresponding to the emitting element array chip 2, and the memory 529 stores line data corresponding to the light emitting element array chip 29.

The description will be made as to writing operation of the line data read from the filter processing portion 408 executed by the chip data converting portion 403 to the memories 501 to 529, and outputting operation of image data written in memories 501 to 529. FIG. 7 is a time chart for explaining the input/output timing of the line data in the chip data converting portion 403. In FIG. 7, a line synchronization signal indicates a pulse signal outputting from the synchronization signal generator 406. In the Figure, TL1, TL2 . . . TL10 indicate period numbers for one line in the sub-scanning direction. In addition, one cycle of the Line synchronization signal is divided into a period Tm1 and a period Tm2 according to the counter value of the counter 530. The input data to the line memory 500 indicates the image data from the filter processing portion 408, and is inputted from the filter processing portion 408 in the period Tm1 of the periods TL1 and TL2. The first line data in the Figure indicates the first line data in the sub-scanning direction (one line in the main scanning direction). Similarly, second line data indicates the second line data in the sub-scanning direction (one line in the main scanning direction) . . . and the tenth line data indicates the tenth line data in the sub-scanning direction (one line in the main scanning direction).

In addition, as for the "input data to the memory 501" shown in FIG. 7, the timing at which the line data corresponding to the light emitting element array chip 1 among the line data for one line in the main scanning direction stored in the line memory 500 is written to the memory 501 is shown. Similarly, for the input data to the memory 502 . . . the input data to the memory 503, the timing at which the line data corresponding to the light emitting element array chips 2, 3 . . . 29 are written in the memories 503 . . . 529 is shown. Here, the first line data of the input data to the memory 501 is the line data (divided line data) in the main scanning direction corresponding to the light emitting element array chip 1, not the entire line data for the one line in the main scanning direction. The same applies to the input data of the memory 502 to the memory 529.

For the "output data from the memory 501" shown in FIG. 7, the timing for reading the line data written in the memory 501 in order to output it to the light emitting element array chip 1 is shown. Similarly, for the 'output data from memory 502' . . . 'output data from memory 529' shown in FIG. 7, the timing of reading for output to light emitting element array chip 2 . . . light emitting element array chip 29, is shown. Here, the first line data of the output data from the memory 501 is not the entire line data for one line in the main scanning direction but is the line data (divided line data) in the main scanning direction corresponding to the light emitting element array chip 1. The same applies to output data from the memory 502 to the memory 529.

In this embodiment, line data for one line in the main scanning direction is sequentially read from the line memory 500, and the writing to the memory 501 which stores the line data of the light emitting element array chip 1 is performed first. Next, the writing to the memory 502 which stores the image data of the light emitting element array chip 2 is then performed, and then the writing is sequentially performed up to the memory 529 which stores the image data of the light emitting element array chip 29. Here, the chip data shift portion 404 at the subsequent stage of the chip data conversion portion 403 performs data shift processing in the sub-scanning direction in the portions of light emitting element array chips. Therefore, the memories 501 to 529 store line data for 10 lines in the sub-scanning direction.

(Chip Data Shift Portion)

The chip data shift portion 404, which is the correction portion, performs the following control. That is, the relative readout timing of the line data from the memories 501 to 529 is controlled based on the data (2400 dpi unit) relating to the image shift amount in the sub-scanning direction for each surface emitting element array chip instructed in advance by the CPU 400. In the following, the image shift process in the sub-scanning direction executed by the chip data shift portion 404 will be specifically described.

It is preferable that there is no deviation in the mounting position of each even-numbered surface emitting element array chip in the longitudinal direction of the exposure head 106. Similarly, also in the longitudinal direction of the exposure head 106, it is preferable that there is no deviation in the mounting position of each odd-numbered surface emitting element array chip. In addition, the mounting positional relationship in the sub-scanning direction between the even-numbered emitting element array chips and the odd-numbered emitting element array chips corresponds preferably to a predetermined number of pixels (for example, 8 pixels) at 2400 dpi. Furthermore, it is preferable that the arrangement position of the light-emitting element array in each light-emitting element array chip in the sub-scanning direction is constant without individual difference. However, the mounting position of the light emitting element array chip and the arrangement position of the light emitting element rows involves errors, and these errors may cause a reduction in image quality of the output image.

The memory 420 (ROM) shown in FIG. 4 stores the correction data calculated from the relative positional relationship in the sub-scanning direction of each light emitting element array of the light emitting element array chips 1 to 29 mounted in a staggered manner on the drive substrate 202. For example, the memory 420 stores the correction data based on the following measurement data. The stored correction data is indicative of the deviation (in the unit of pixel equivalent to 2400 dpi in the sub scanning direction) of the light emitting element row of a light emitting element array chip 2 to 29 is mounted on the drive substrate 202 from the light emitting element row of the light emitting element array chip 1 as a reference for the position in the sub scanning direction. After mounting the surface emitting element array chips 2 to 29 on the drive board 202, the light emitting elements of each light emitting element array chip by the measuring device are activated, and the measurement is performed based on the received light then. The CPU 400 sets the correction data read from the memory 420 in the internal register of the chip data shift portion 404 in response to the power supply of the image forming apparatus being turned on. The chip data shift unit 404 performs line data shift processing for forming the same line stored in the memories 501 to 529 based on the correction data set in the internal register. For example, when the light-emitting element array of the light-emitting element array chip 2 is mounted on the drive substrate is deviated relative to relative to the light-emitting element array of the light-emitting element array chip 1 by 8 pixels in the sub-scanning direction in an equivalent of 2400 dpi, the chip data shift portion 404 performs the following processing. That is, the chip data shift portion 404 delays the output timing of line data corresponding to the surface emitting element array chip 2 forming the same line by 8 pixels, with respect to the output timing of the line data corresponding to the surface emitting element array chip 1 to the driving substrate 202. Therefore, the chip data shift unit 404 shifts all line data corresponding to the light emitting element array chip 2 with respect to the line data corresponding to the surface emitting element array chip 1.

(Data Transmission Portion)

The data transmission unit 405 transmits the line data after performing the above-described data processing on the series of line data to the driving substrate 202 of the exposure head 106.

Referring to FIG. 7 described above, the image data transmission timing will be described. As shown in part (a) of FIG. 3, of the light emitting element array chips, odd-numbered light emitting element array chips 1, 3, 5 . . . 29 are arranged on the upstream side in the sub-scanning direction, and even-numbered light emitting element array chips 2, 4, 6 . . . 28 are arranged on the downstream side in the sub-scanning direction. In the time chart shown in FIG. 7, the writing of the image data corresponding to the odd-numbered light emitting element array chip 1 . . . 29 into the memory 501 . . . memory 529 is performed in the period of the first line synchronization signal (TL1 in the Figure) And, during the next line synchronization signal period (TL2 in the Figure), the first line in the sub-scanning direction from the memory 501 . . . memory 529 corresponding to the odd-numbered light emitting element array chip 1 . . . 29 is read out. Similarly, further, in the next line synchronization signal period, data in the second line in the sub-scanning direction is read from the memory 501 . . . the memory 529 corresponding to the odd-numbered light emitting element array chip 1 . . . 29. And, in the period of the 10th line synchronization signal (TL10 in the Figure), the data for the ninth line in the sub-scanning direction is read out of the memory 501 . . . memory 529, corresponding to the odd-numbered light emitting element array chip 1 . . . 29. In addition, image data is read from the memory 502 corresponding to the even-numbered light-emitting element array chip 2 in the period TL1 during which image data is written to the memory 502 to 9 pulses after the Line synchronization signal (TL10 in the Figure).

The data transmitting portion 405 transmits the line data processed by the chip data shifting portion 404 to the driving substrate 202. The data transmitting portion 405 includes a frequency modulation circuit which modulates the input line synchronization signal and generates a clock signal including a frequency higher than that of the line synchronization signal, instead of the oscillator. In addition, the data transmitting portion 405 may include an oscillator which generates a clock signal having a frequency higher than that of the Line synchronization signal instead of the frequency modulation circuit. In this embodiment, the frequency of the clock signal (CLK in FIG. 7) is determined such that the count value is 29, 704 (twice the number of pixel data in one line) or more within one cycle of the line synchronization signal. By this, the image data can be inputted (written) to the line memory 500, and the image data can be outputted (written) from the line memory 500 to the memories 501 to 529 within one cycle of the Line synchronization signal.

On the other hand, for reading the data from the memories 501 to 529, the image data, for one line in the main scanning direction, corresponding to each light emitting element array chip are outputted in parallel from the 29 memories 501 to 529, within one period of the line synchronization signal. Therefore, the reading speed of the image data from the memories 501 to 529 may be lower than the writing speed to the memory. For example, in this embodiment, the image data is read from the memories 501 to 529 in a period which is 58 times longer than the period of the clock signal when the image data is written to the memories 501 to 529.

[Exposure Head Driver]

(Data Receiver)

Next, the processing inside the drive portion 303*a* of the exposure head 106 will be described.

The drive portion 303*a* includes functional blocks of a data reception portion 407, a PWM signal generation portion 411, a timing controller 412, a control signal generation portion 413, and a drive voltage generation portion 414. In the following, the processing of each functional block will be described in the order in which image data is processed by the drive portion 303*a*. Here, as described above, the chip data conversion portion 403 arranges image data for each of the 29 light emitting element array chips, and the subsequent processing blocks are constituted to process each image data stored in the 29 chips in parallel. The driving portion 303*a* includes a circuit which receives image data corresponding to the light emitting element array chips 1 to 15 and can process each light emitting element array chip in parallel.

(Data Receiver)

The data receiving portion 407 receives a signal transmitted from the data transmitting portion 405 of the control board 415. Here, the data reception portion 407 and the data transmission portion 405 transmit and receive image data in the portion of lines in the sub-scanning direction in synchronization with the line synchronization signal.

(LUT)

Subsequently LUT 410 converts the image data value (density data value) for each pixel corresponding to the light emitting element in the light emitting element array chip with reference to a look-up table (Look Up Table) The look-up table LUT 410 converts the data value for each pixel based on the response characteristics of the light emission time of the light emitting element array chip so that the integrated light quantity upon pulsed light emission is a predetermined level. For example, when the response of the light emission time of the light emitting element array chip is slow and the integrated light quantity is smaller than the target value, the data conversion is performed such that the data value increases. In this embodiment, before starting image formation, the CPU 400 selects the value of the conversion table set in the look-up table to be a predetermined value based on the experimentally obtained response characteristics of the light emitting element array.

FIG. 8 shows a table showing an example of the look-up table, and the look-up table LUT 410 uses the conversion table of one of parts (a) to (c) of FIG. 8 to convert pixel data equivalent to 1200 dpi into a PWM signal. The look-up table shown in FIG. 8 is a conversion Table used in conversion of the pixel density values (5 values of 0%, 25%, 50%, 75%, and 100%) which are pixel data equivalent to 1200 dpi converted by the filter processing portion 408 into 8-bit PWM data. The numbers "000", "001", "010", "011", and "100" in the binary display in the left column of the conversion table shown in parts (a) to (c) of FIG. 8 is pixel data, equivalent to 1200 dpi, corresponding to the values 0%, 25%, 50%, 75%, and 100%. In addition, the PWM data in the conversion table shown in parts (a) to (c) of FIG. 8 indicates 8-bit data corresponding to the density value of the pixel. The number "1" in the PWM data is LED-on data (light emission data) and "0" is LED-off data (non-light emission data) The PWM data corresponds to ΦW1 to ΦW4 which will be described hereinafter. For example, the PWM data corresponding to "000" corresponding to the pixel density value of 0% is "00000000" in any of the conversion tables of parts (a) to (c) of FIG. 8. In addition, the PWM data corresponding to "100" corresponding to the pixel density value of 100% is "11111111" in any of the conversion tables of parts (a) to (c) of Figure. On the other hand, the PWM data corresponding to "001", "010", and "011" corresponding to pixel density values of 25%, 50%, and 75% are 8 bit data which are different from each other in parts (a) to (c) of FIG. 8. For example, the PWM data corresponding to "010" having a pixel density value of 50% is "00001111" in part (a) of FIG. 8, "11110000" in part (b) of FIG. 8, and is "00111100" in part (c) of FIG. 8.

(PWM Signal Generator, Timing Controller, Control Signal Generator, Drive Voltage Generator)

The PWM signal generator 411 generates a pulse width signal (hereinafter referred to as the pulse width signal) provided corresponding to the light emission time performed in one pixel portion by the surface emitting element array chip in accordance with the data value for each pixel. The timing for outputting the PWM signal is controlled by the timing controller 412. The timing controller 412 generates a synchronization signal corresponding to the pixel section of each pixel from the Line synchronization signal generated by the synchronization signal generation portion 406 of the control board 415, and outputs the synchronization signal to the PWM signal generation portion 411. The drive voltage generator 414 generates a drive voltage for driving the surface emitting element array chip in synchronization with the PWM signal. Here, the drive voltage generation portion 414 has a structure in which the voltage level of the output signal can be adjusted around 5V so that the CPU 400 provides a predetermined light intensity. In this embodiment, each light emitting element array chip is constituted such that four light emitting elements can be driven independently from each other at the same time. The drive voltage generator 414 supplies drive signals to 4 lines of drive signal for each surface emitting element array chip, that is, for the entire exposure head 106, supplies drive signals to staggered 1 line ((15 chips)×4=60 lines). Drive signals supplied to each light emitting element array chip are ΦW1 to ΦW4 (FIG. 9) On the other hand, the light emitting element chip array is sequentially driven by the operation of a shift thyristor (FIG. 9) which will be described hereinafter. The control signal generation portion 413 generates control signals Φs, Φ1, and Φ2 for transferring the shift thyristor for each pixel from the synchronization signal corresponding to the pixel portion generated by the timing controller 412 (FIG. 9).

[SLED Circuit]

FIG. 9 is an equivalent circuit in which a part of the self-scanning LED (SLED) chip array of this embodiment is extracted. In FIG. 9, Ra and Rg are anode resistance and gate resistance respectively, Tn is a shift thyristor, Dn is a transfer diode, and Ln is a light emitting thyristor. In addition, Gn depicts a common gate of the corresponding shift thyristor Tn and the light emitting thyristor Ln connected to the shift thyristor Tn. Here, n is an integer of 2 or more. Φ1 is a transfer line of an odd-numbered shift thyristor T, and Φ2 is a transfer line of an even-numbered shift thyristor T. ΦW1 to ΦW4 are lighting signal lines for the light-emitting thyristor L, and are connected to resistors RW1 to RW4, respectively. VGK is a gate line, and Φs is a start pulse line. As shown in FIG. 9, four light emitting thyristors L4*n*−3 to L4*n* are connected to one shift thyristor Tn, and the four light emitting thyristors L4*n*−3 to L4*n* can be turned on simultaneously.

[Operation of SLED Circuit]

The operation of the SLED circuit shown in FIG. 9 will be described. Here, in the circuit illustration of FIG. 9, it is assumed that 5V is applied to the gate line VGK, and the voltages inputted to the transfer lines Φ1, Φ2 and the lighting signal lines ΦW1 to ΦW4 are also 5V. In FIG. 9, when the shift thyristor Tn is on, the potential of the common gate Gn of the light-emitting thyristor Ln connected to the shift thyristor Tn and the shift thyristor Tn is lowered to about 0.2V. The common gate Gn of the light emitting thyristor Ln and the common gate Gn+1 of the light emitting thyristor Ln+1 are connected by a coupling diode Dn, and therefore, a potential difference substantially equal to the diffusion potential of the coupling diode Dn is generated. In this embodiment, the diffusion potential of the coupling diode Dn is about 1.5V, and therefore, the potential of the common gate Gn+1 of the light emitting thyristor Ln+1 is 1.7V (=0.2V+1.5V) obtained by add in g 1.5V of the diffusion potential to 0.2V of the potential of the common gate Gn of the light emitting thyristor Ln. Similarly, the potential of the common gate Gn+2 of the light emitting thyristor Ln+2 is 3.2V (=1.7V+1.5V), and the potential of the common gate Gn+3 (not shown) of the light emitting thyristor Ln+3 (not shown) is 4.7V (=3.2V+1.5V) However, the potential after the common gate Gn+4 of the light-emitting thyristor Ln+4 is 5V because the voltage of the gate line VGK is not higher than this, and therefore, it is 5V. In addition, as to the potential of the common gate Gn−1 before the common gate Gn of the light emitting thyristor Ln (left side of the common gate Gn in FIG. 11), the coupling diode Dn−1 is reverse biased, and therefore, the voltage of the gate line VGK is applied as it is, and it is 5V.

Part (a) of FIG. 10 is an illustration showing the distribution of the gate potential of the common gate Gn of each light-emitting thyristor Ln when the above-described shift thyristor Tn is in the on state, in which the common gates Gn−1, Gn, Gn+1, and so on depict the common gates of the light emitting thyristors L in FIG. 9. In addition, the vertical axis of part (a) in FIG. 10 indicates the gate potential. The voltage required to turn on each shift thyristor Tn (hereinafter referred to as the threshold voltage) is substantially the same as the gate potential of the common gate Gn of each light-emitting thyristor Ln plus the diffusion potential (1.5V). When the shift thyristor Tn is on, the shift thyristor Tn+2 has the lowest gate potential of the common gate among the shift thyristors connected to the transfer line Φ2 of the same shift thyristor Tn. The potential of the common gate Gn+2 of the light emitting thyristor Ln+2 connected to the shift thyristor Tn+2 is 3.2V (=1.7V+1.5V) (part (a) of FIG. 12) as described above. Therefore, the threshold voltage of the shift thyristor Tn+2 is 4.7V (=3.2V+1.5V) However, shift thyristor Tn is on, and therefore, the potential of transfer line Φ2 is drawn to about 1.5V (diffusion potential), and it is lower than the threshold voltage of shift thyristor Tn+2, so that shift thyristor Tn+2 cannot be turned on. Other shift thyristors connected to the same transfer line Φ2 have a higher threshold voltage than the shift thyristor Tn+2, and therefore, it cannot be turned on, either, and only the shift thyristor Tn can be kept on.

In addition, for shift thyristors connected to transfer line Φ1, the threshold voltage of the shift thyristor Tn+1 where the threshold voltage is the lowest is 3.2V (=1.7V+1.5V). Next, the shift thyristor Tn+3 (not shown in FIG. 9) having the lowest threshold voltage is 6.2V (=4.7V+1.5V). In this state, when 5V is inputted to the transfer line Φ1, only the shift thyristor Tn+1 can be turned on. In this state, the shift thyristor Tn and the shift thyristor Tn+1 are in the on-state simultaneously. Therefore, gate potentials of shift thyristors Tn+2, Tn+3, and so on provided on the right side of the shift thyristor Tn+1 in the circuit shown in FIG. 9 is lowered by the amount corresponding to the diffusion potential (1.5V). However, the voltage of the gate line VGK is 5V, and the common gate voltage of the light emitting thyristor L is limited by the voltage of the gate line VGK, and therefore, the gate potential on the right side of the shift thyristor Tn+5 is 5V. Part (b) of FIG. 10 shows the gate voltage distribution of each of the common gates Gn−1 to Gn+4 at this time, in which the vertical axis represents the gate potential. In this state, when the potential of the transfer line Φ2 is lowered to 0V, the shift thyristor Tn is turned off, and the potential of the common gate Gn of the shift thyristor Tn is increased to the VGK potential. Part (c) of FIG. 10 is an illustration showing the gate voltage distribution at this time, in which the vertical axis shows the gate potential. In this manner, the on-state transfer from the shift thyristor Tn to the shift thyristor Tn+1 is completed.

[Light Emission Operation of Light Emitting Thyristor]

Next, a light emitting operation of the light emitting thyristor will be described. When only the shift thyristor Tn is on, the gates of the four light emitting thyristors L4*n*−3 to L4*n* are connected in common to the common gate Gn of the shift thyristor Tn. Therefore, the gate potentials of the light emitting thyristors L4*n*−3 to L4*n* are 0.2V, which is the same as that of the common gate Gn. Therefore, the threshold value of each light emitting thyristor is 1.7V (=0.2V+1.5V), and if a voltage of 1.7V or more is inputted from the lighting signal lines ΦW1 to ΦW4 of the light emitting thyristors, the light emitting thyristors L4*n*−3 to L4*n* can be turned on. Therefore, by inputting a lighting signal to the lighting signal lines ΦW1 to ΦW4 when the shift thyristor Tn is on, the four light emitting thyristors L4*n*−3 to L4*n* can selectively emit light. At this time, the potential of the common gate Gn+1 of the shift thyristor Tn+1 next to the shift thyristor Tn is 1.7V, and the threshold voltage of the light emitting thyristors L4*n*+1 to 4*n*+4 connected to the common gate Gn+1 is 3.2V (=1.7V+1.5V) The lighting signal inputted from lighting signal lines ΦW1 to ΦW4 is 5V, and therefore, the light-emitting thyristors L4*n*+1 to L4*n*+4 are likely to light up with the same lighting pattern as the light-emitting thyristors L4*n*−3 to 4*n*. However, the threshold voltage is lower in the light emitting thyristors L4*n*−3 to L4*n*, and therefore, when a lighting signal is inputted through the lighting signal lines ΦW1 to ΦW4, they turn on earlier than light-emitting thyristors L4*n*+1 to L4*n*+4. Once the light emitting thyristors L4*n*−3 to L4*n* are turned on, the connected lighting signal lines ΦW1 to ΦW4 are lowered to about 1.5V (diffusion potential) Therefore, the potential of the lighting signal lines ΦW1 to ΦW4 becomes lower than the threshold voltage of the light emitting thyristors L4*n*+1 to L4*n*+4, and therefore, the light emitting thyristors L4*n*+1 to L4*n*+4 cannot be turned on. As described above, by connecting the multiple light-emitting thyristors L to one shift thyristor T, the plurality of light-emitting thyristors L can be turned on simultaneously.

FIG. 11 is a timing chart of the drive signals for the SLED circuit shown in FIG. 9. FIG. 11 shows the voltage waveforms of the drive signals for the gate line VGK, the start pulse line Φs, the odd-numbered and even-numbered shift thyristor transfer lines Φ1, Φ2, and the light-emitting thyristor lighting signal lines ΦW1-ΦW4, in this order from top to bottom. Here, each drive signal has an on-state voltage of 5V and an off-state voltage of 0V. In addition, the horizontal axis in FIG. 11 indicates time. In addition, Tc indicates the period of the clock signal Φ1, and Tc/2 indicates a period that is half (=½) of the period Tc.

The voltage of 5V is always applied to the gate line VGK. In addition, the clock signal Φ1 for the odd-numbered shift thyristor and the clock signal Φ2 for the even-numbered shift thyristor are inputted at the same period Tc, and 5V is supplied as the signal Φs for the start pulse line. To make a potential difference on the gate line VGK shortly before the clock signal Φ1 for the odd-numbered shift thyristor first becomes 5V, the signal Φs on the start pulse line is dropped to 0V. By this, the gate potential of the first shift thyristor Tn−1 is lowered from 5V to 1.7V, so that the threshold voltage becomes 3.2V, and therefore it can be turned on by a signal from the transfer line Φ1. Voltage 5V is applied to the transfer line Φ1, and 5V is supplied to the start pulse line Φs, slightly after the first shift thyristor Tn−1 is turned on, and thereafter, 5V is continuously supplied to the start pulse line Φs.

The structure is such that the transfer line Φ1 and the transfer line Φ2 have a time period Tov where the ON states (5V in this case) overlap each other, and are in a substantially complementary relationship. The light-emitting thyristor lighting signal lines ΦW1 to ΦW4 are transmitted in half the cycle of the transfer lines Φ1 and Φ2, and lights up when 5V is applied under the condition that the corresponding shift thyristor is on. For example, in the period a, all four light emitting thyristors connected to the same shift thyristor are turned on, and in the period b, the three light emitting thyristors are turned on simultaneously. In addition, in the period c, all the light emitting thyristors are turned off, and in the period d, the two light emitting thyristors are turned on simultaneously. In the period e, only one light-emitting thyristor is turned on.

In this embodiment, the number of light emitting thyristors connected to one shift thyristor is four, but it is not limited to this example, and may be less or more than four depending on the situation. Here, in the circuit described above, the cathode of each thyristor is shared, but an anode common circuit can be used by appropriately inverting the polarity.

[Structure of Surface Light Emitting Thyristor]

Parts (a) and (b) of FIG. 12 illustrate the emitting thyristor portion of this embodiment. Part (a) of FIG. 12 is a plan view (schematic illustration) of a light-emitting element array in which a plurality of light-emitting elements formed in a mesa (trapezoidal) structure 922 are arranged. Part (b) of FIG. 12 is a schematic cross-sectional view of the light-emitting element formed in the mesa structure 922 taken along a line BB shown in part (a) of FIG. 12. The mesa structures 922 in which the light emitting element is formed are arranged at a predetermined pitch (interval between adjacent light emitting elements) (for example, approximately 21.16 μm in the case of 1200 dpi resolution), and they are separated from each other by grooves 924.

In part (b) of FIG. 12, reference numeral 900 depicts a compound semiconductor substrate of the first conductivity type: 902 is a buffer layer of the same first conductivity type as the substrate 900; and 904 is a distributed Bragg reflection (DBR) layer comprising a stack of two types of semiconductor layers of the first conductivity type. In addition, reference numeral 906 depicts a first conductivity type semiconductor layer; 908 is a first second-conductivity-type semiconductor layer different from the first conductivity type; 910 is a second first-conductivity type semiconductor layer; and 912 is a second second-conductivity-type semiconductor layer. As shown in part (b) of FIG. 12, a pnpn type (or npnp type) thyristor structure is formed by alternately laminating semiconductors having different conductivity types of the semiconductor layers 906, 908, 910, and 912. In this embodiment, the substrate 900 is a n-type GaAs substrate, the buffer layer 902 is a n-type GaAs or a n-type AlGaAs layer, and the DBR layer 904 is a laminated structure of a n-type high Al composition AlGaAs layer and a low Al composition layer. The n-type AlGaAs is used for the first first-conductivity-type semiconductor layer 906 on the DBR layer, and p-type AlGaAs is used for the first second-conductivity-type semiconductor layer 908. In addition, the second first-conductivity-type semiconductor layer 910 uses n-type AlGaAs, and the second second-conductivity-type semiconductor layer 912 uses p-type AlGaAs.

In addition, in the mesa structure type light emitting device, the light emission efficiency is improved by using a current confinement mechanism to prevent the current from flowing to the side surface of the mesa structure 922. Here, the current confinement mechanism in this embodiment will be described. As shown in part (b) of FIG. 12, in this embodiment, a p-type GaP layer 914 is formed on a p-type AlGaAs which is the second second-conductivity-type semiconductor layer 912, and an ITO layer 918 which is a n-type transparent conductor is further formed thereon. The p-type GaP layer 914 is formed with a sufficiently high impurity concentration in the portion in contact with the ITO layer 918 of the transparent conductor. When a forward bias is applied to the light emitting thyristor (for example, when the back electrode 926 is grounded and a positive voltage is applied to the front electrode 920), a tunnel junction is established because the p-type GaP layer 914 is formed with a sufficiently high impurity concentration in the portion in contact with the ITO layer 918 of the transparent conductor. As a result, the current flows. With such a structure, the p-type GaP layer 914 concentrates the current on the portion of the n-type transparent conductor in contact with the ITO layer 918 to form a current confinement mechanism. Here, in this embodiment, an interlayer of insulating layer 916 is provided between the ITO layer 918 and the p-type AlGaAs layer 912. However, the mounted diode formed by the n-type ITO layer 918 and the p-type AlGaAs layer 912 is reverse-biased with respect to the forward bias of the light-emitting thyristor, and therefore, when the forward-bias is applied, basically no current flows other than at the tunnel junction. Therefore, it can be omitted, if the reverse diode withstand voltage of the mounted diode formed by the n-type ITO layer 918 and the p-type AlGaAs layer 912 is sufficient for the required usage. With this structure, the light is emitted by the semiconductor lamination portion under the portion substantially equivalent to the portion where the p-type GaP layer 914 and the n-type transparent conductor ITO layer 918 are in contact, and the DBR layer 904 reflects most of the emitted light to the opposite side of the substrate 900.

In the exposure head 106 in this embodiment, the density of light emitting points (interval between light emitting elements) is determined depending on the resolution. The light emitting elements inside the light emitting element array chip are separated into mesa structures 922 by element separating grooves 924, and, when forming an image with a resolution of 1200 dpi, for example, the distance between the element centers of adjacent light emitting elements (light emitting points) is arranged to be 21.16 μm.

[Relationship Between the Structure of Overlapping Portions and the Image to be Formed]

Next, the description will be made as to the image processing in the overlapping portion of the light emitting elements of the light emitting element array chips 1 to 29. FIG. 13 is a view illustrating the relationship between the structure of the joint portion of each light emitting element array chip and the image (halftone) to be formed. Here, this will be explained using the light emitting element array chips 1, 2, and 3. Part (a) of FIG. 13 is an illustration showing an arrangement structure of overlapping portions of the light emitting elements of the light emitting element array chips 1, 2, and 3 and part (b) of FIG. 13 shows an image formed by the light emitting element array chips 1, 2, and 3 shown in part (a) of FIG. 13. Here, in order to simplify the description, of the overlapping light emitting elements, only one light emitting element emits light, and the other light emitting element does not emit light. That is, for the overlapping portion of the light emitting element array chips 1 and 2, the light emitting element of the light emitting element array chip 1 emits light, and the light emitting element of the light emitting element array chip 2 does not emit light. On the other hand, for the overlapping portion of the light emitting element array chips 2 and 3, the control is performed so that the light emitting elements of the light emitting element array chip 2 emit light and the light emitting elements of the light emitting element array chip 3 do not emit light. In part (a) of FIG. 13, the hatched light-emitting elements indicate the elements that emit light.

The stripe in the image of the overlapped portion between the light emitting element array chips 1, 2, and 3 shown in part (b) of Figure is produced by variation in mounting (mounting error) of the light emitting element array chip on the driving substrate 202 or by thermal expansion of the driving substrate 202. The gap b between the light emitting elements at the joint between the light emitting element array chip 1 and the light emitting element array chip 2 in part (a) of FIG. 13 is smaller than the desired distance a between the light emitting elements (interval a>interval b), in this example. When the relationship between the distances an and b is such that the distance a>the distance b, the light emitting elements at the ends of the light emitting element array chips 1 and 2 are displaced so as to overlap each other. Therefore, at the joint portion between the light emitting element array chip 1 and the light emitting element array chip 2, the amount of light when the light emitting element emits light increases, with the result that a dark image is formed. That is, a portion of the exposure range (1 pixel) of the light emitting element located on the rightmost side of the light emitting element array chip 1, and a portion of the exposure range (1 pixel) of the light emitting element located on the leftmost side of the light emitting element array chip 2 will overlap each other. Therefore, the exposure amount of the portion that is exposed in duplicate is larger than the exposure amount when the light emitting element array chip is ideally mounted on the printed circuit board, and as a result, the image density of the joint is formed with the density higher than the desired density. As a result, as shown in part (b) of FIG. 13, an image is formed as black stripe.

On the other hand, the interval c between the light emitting elements in the joint portion between the light emitting element array chip 2 and the light emitting element array chip 3 is larger than the desired light emitting element interval a (interval a<interval c). When the relationship between the distances an and c is such that the distance a<the distance c, the light emitting elements at the ends of the light emitting element array chips 2 and 3 are displaced away from each other. Therefore, at the joint between the light emitting element array chip 2 and the light emitting element array chip 3, the amount of light when the light emitting element emits light decreases, and an image is formed with a low density. That is, the center-to-center distance between the light emitting element located on the rightmost side of the light emitting element array chip 2 and the light emitting element located on the leftmost side of the light emitting element array chip 2 is larger than the nominal value. Therefore, the exposure amount of the portion is smaller than the exposure amount when the light emitting element array chip is ideally mounted on the printed circuit board, and as a result, the image density at the joint is formed with the density higher than the desired density. As a result, as shown in part (b) of FIG. 13, an image is formed as white stripes.

[Image Processing for Overlapping Portions]

Next, the image processing in the overlapping portion of the light emitting element array chips arranged in a staggered manner in the longitudinal direction of this embodiment will be described. In the following, the overlapping amount of the light emitting elements between the light emitting element array chips is four elements. In the memories 501 to 529 of the chip data converting portion 403 described above, the image data for the four light emitting elements which overlap with the light emitting element array chips is also stored in addition to the image data (for 516 elements) corresponding to each light emitting element array chip 1 to 29. In addition, in order to control the memories 501 to 529 by the memory controller 532, the address signals, the chip selection signals, and the write-enabling signal control signals (memory 501 control signals to memory 529 control signals shown in FIG. 6) are outputted into the memories 501 to 529. Here, the chip selection signal is a signal for selecting the memories 501 to 529, and when the signal is at a low level, the corresponding memories 501 to 529 are selected. In addition, the write-enabling signal is a signal which enables the writing process to the corresponding memories 501 to 529 when the level is low.

FIG. 14 is a view illustrating the correspondence between the one-line image data stored in the line memory 500 and the image data stored in the memories 501 to 529 by the control signal from the memory controller 532. In FIG. 14, numerals 1 to 14852 in one line image data indicate pixel positions in one line in the main scanning direction. In addition, numbers 1 to 14852 in the memories 501 to 529 represent pixel positions of one-line image data stored in the line memory 500. Here, addresses 1 to 516 of the memories 501 to 529 correspond to the light emitting elements inside the light emitting element array chips 1 to 29. For example, address 1 corresponds to the first light emitting element, address 2 corresponds to the second light emitting element, and address 516 corresponds to the 516th light emitting element.

In addition, the storage locations of the pixel data in the overlapping memory 501 to 529 corresponding to the respective light emitting element array chips 1 to 29 are as follows when N is 501 to 528. That is, the pixel data stored at addresses 513 to 516 of the memory (N) and the pixel data stored at addresses 1 to 4 of the memory (N+1) are the same in the pixel position (overlapping image position) on one line where the image is formed. Therefore, there are 28 overlapping positions of the pixel positions on which 29 light emitting element array chips 1 to 29 form the image. In the following, the image arrangement of each memory 501 to 529 for the overlapping portion is called duplications 1 to 28.

[Selection Control During Memory Storage]

As shown in FIG. 6, for the duplications 1 to 28 of memories 501 to 529, a duplication controller 533 selects a memory so that pixel data read from line memory 500 is stored only in one of the memories 501 to 529 at the same duplicating pixel position. And, "0" is stored as the value of the pixel data in the overlapping pixel positions of the memories 501 to 529 which are not selected. The duplication controller 533 performs pixel data selection control for duplications 1 to 28 for each pixel (for each light emitting element), and stores the pixel data in the addresses corresponding to two overlapping light emitting element positions in the memories 501 to 529. The above-mentioned selection control of the memories 501 to 529 is not performed for pixel positions other than the duplications 1 to 28 so that pixel data read from the line memory 500 via the memory controller 532 is stored at addresses corresponding to the light emitting element positions of the memories 501 to 529.

The number of image data selection patterns for the duplications 1 to 28 selected by the duplication controller 533 can be obtained by the following (Equation 2) according to the duplication number.

$$\text{Number of image data storage patterns} = 2^{(\text{number of duplications})} \quad \text{(Equation 2)}$$

As shown in Figure when the overlap number is four elements, the image data storage patterns for the duplications 1 to 28 according to (Equation 2) are 16 types of patterns shown in FIG. 14. FIG. 15 is a table showing image data storage patterns when the duplication number is four (elements). In FIG. 15, the corresponding memory of each pattern is memory N (memory 501 to 528) and memory N+1 (memory 502 to 529), and the overlapping pixels 1 to 4 indicate the overlapping pixels in the memories 501-529. Here, overlapping pixels 1 to 4 indicate the positions, in the main scanning direction, of the duplications 1 to 28 of the memories 501 to 529, and if the number in the table is '1', the image data read from the line memory 500 by way of the memory controller 532 is stored. On the other hand, when the number in the table is '0', the control is performed to store '0' as the value of the pixel data.

[Structure of Duplicate Controller]

FIG. 16 is a block diagram showing a structure of the duplication controller 533. As shown in FIG. 16, the duplication controller 533 includes a pseudo-random number generator 534, a random number storage portion 536, an overlapping pixel switching portion 535, and an image data distributor 537. The pseudo-random number generator 534, which is an output portion, is a general linear feedback shift register (LFSR), for example, and the image data distributor 537 selects pixel data to be output to the memories 501 to 529 in accordance with the value "0" or "1" outputted from the pseudo-random number generator 534. The image data distributor 537 comprises two selectors 539 and 540. The image data from the line memory 500 read by way of the memory controller 532 is inputted to the input port 1 of each selector, and '0' (GND) is inputted to the input port 0. In addition, from the pseudo-random number generator 534, a select signal (selection signal) instructing selection of the input port 0 or the input port 1 is inputted to the selectors 539 and 540. Here, as the select signal, different signals are inputted to the two selectors 539 and 540, more particularly, a signal provided by inverting the select signal inputted to the selector 539 is inputted to the selector 540. For example, when the select signal inputted to selector 539 indicates the input port 0, the select signal inputted to selector 540 indicates input port 1. And, the selectors 539 and 540 output the pixel data corresponding to the light emitting elements of the two light emitting element array chips which have overlapping light emitting elements.

[Operation of Duplication (Overlapping) Controller]

The operation of the image data distributor 537 will be described with an example of image data distribution processing of the pixel positions 513 and 514 in the memory 501 and the memory 502. If the pseudo-random number output of the pseudo-random number generator 534 is '0' for the pixel position 513, the output of selector 539 is selected from input port 0, and as an output of the selector 540, an input from the input port 1 is selected. As a result, the selector 539 outputs '0' as the pixel data at the pixel position 513 of the memory 501, and the selector 540 outputs the pixel value at the pixel position 513 read from the line memory 500 as the pixel data at the pixel position 513 in the memory 502. Next, when the pseudo-random number output of the pseudo-random number generator 534 is '1' for the pixel position 514, the input from input port 1 is selected, for the output of selector 539, and an input from the input port 0 is selected, for the output of the selector 540. As a result, the selector 539 outputs the pixel value of the pixel position 514 read from the line memory 500 as the pixel data of the pixel position 514 of the memory 501, and the selector 540 outputs "0" as the pixel data of the pixel position 514 of the memory 502. The duplication controller 533 performs the above-described processing on pixel data at the same pixel position of duplications 1 to 28.

Here, the control signal from the memory controller 532 which is outputted to the memories 501 to 529 during the processing of the overlappings 1 to 28 is controlled as follows. That is, the memory 501 and memory 502 will be taken as an example. When the count value of the counter 530 reaches an overlapping portion (513), the chip enable signal and the write enable signal of the memory 502 become low level, and the writing process to the memory 502 becomes enabled. Here, in the memory 501, the chip enable signal and the write enable signal are already at the low level, and the write processing to memory 501 is enabled, and therefore, pixel data is written. On the other hand, when the address signal to the memory 501 which specifies the pixel position is 513, the address signal to the memory 502 is 1, and subsequently each time pixel data is inputted, the address signal is incremented and counted up to 516 sequentially. When the count value of the counter 530 becomes a count value other than the overlapping portion, the chip enable signal and write enable signal to the memory 501 become high level, the write processing to the memory 501 is disabled.

When it is determined that the count value input from the counter 530 is other than the overlapping portion (for example, the count value is 517), the overlapping pixel switching portion 535 outputs the pixel data read from the line memory 500 not the pixel data selected and controlled by the image data distributor 537. By this, the 517th pixel data read from the line memory 500 by way of the memory controller 532 is stored at address 5 of the memory 502. Thereafter, when the count value inputted from the counter 530 is indicative of other than the overlapping portion, the image data read from the line memory 500 by way of the memory controller 532 is sequentially stored in the memory 502.

In addition, the pseudo-random number generator 534 is connected to the random number storage portion 536 which is a storage portion, and the random number storage portion 536 stores random number values corresponding to the duplicates 1 to 28 in one line in the main scanning direction. The pseudo-random number generator 534 receives an instruction signal from the CPU 400, a counter value from the counter 530, and a line synchronization signal. The CPU 400 outputs a signal instructing the pseudo-random number generator 534 to indicate the overlapping pixel position and the number of lines at each of which a random number is generated. For example, when an instruction to generate a random number every two lines is inputted from the CPU 400, the pseudo-random number generator 534 operates as follows. That is, the pseudo-random number generator 534 generates random numbers every time the line synchronization signal is input twice at overlapping pixel positions 1 to 28 where the overlapping pixel position indicated by the CPU 400 matches the counter value from the counter 530. The pseudo-random number generator 534 stores the random number values generated at that time (28 overlapping points×4 elements of random values) in the random number storage portion 536. And, when the next line synchronization signal is inputted, the pseudo-random number generator 534 reads the random number values stored in the random number storage portion 536, outputs the read random values to the image data distributor 537, and selects pixel data. Here, as an example of processing for multiple lines, the processing for every two lines is employed because in this example, the resolution in the sub-scanning direction is 2400 dpi, and the resolution in the main scanning direction is 1200 dpi, that is, it is employed because the processing resolutions are made the same. By this, it is possible to reduce the quality degradation of the formed image due to the difference in resolution between the main scanning direction and the sub-scanning direction.

In addition, the pseudo-random number generator 534 can also stop the random number generation in response to an instruction from the CPU 400. In such a case, the pseudo-random number generator 534 reads the random number values stored in the random number storage portion 536 and outputs the read random number value to the image data distributor 537, by which pixel data is selected in the image data distributor 537. As described above, the random number storage portion 536 is constituted to be able to rewrite the random number value by way of the pseudo-random number generator 534 according to an instruction from the CPU 400.

FIG. 17 is an illustration of the control of the duplication controller 533 of this embodiment. Part (a) in FIG. 17 is an image drawing at the time when the pixel data is distributed to memories N and N+1 in the duplications 1 to 28 of memories 501 to 529, for each line from the first line to the 16th line in the sub-scanning direction, in the duplication controller 533. In part (a) of FIG. 17, N is 501 to 528, and the pixel data (emitting pixel data) in which the hatched pixels are selected in the overlapping portions between the addresses 513 to 516 of the memory N and the addresses 1 to 4 of the memory N+1. The pattern order by selection control for each line is not limited to the pattern shown in part (a) of FIG. 17, and the storage pattern of image data shown in FIG. 15 is selected and controlled at random. Therefore, even in the duplicates 1 to 28 of the light emitting element array chips 1 to 29, the selection control can be performed at random. In addition, part (b) of FIG. 17 is an image Drawing of a halftone image formation image of black stripes and white stripes generated when this embodiment is not applied, and part (c) of FIG. 17 is an image drawing of a halftone image formation image when this embodiment is applied. It is understood that the black stripes and the white stripes are not formed by using this embodiment.

As described above, the CPU 400 which is the controller, varies the light emission pattern for each line by determining which of the two light emitting elements arranged in the width direction of the substrate 202 in the overlaps 1 to 28 is driven to emit the light. By this, the conspicuousness of black and white stripes can be suppressed. Here, of the two light emitting elements arranged in the width direction of the substrate 202, one light emitting element may be turned off while the other light emitting element is turned on.

In addition, as described above, the image data is distributed randomly for each line, and therefore, the light emission pattern is not necessarily different for each line. The same light emission pattern may be continued for every predetermined number of lines, for example, 2 to 5 lines.

In addition, the light emission pattern may be intentionally changed every predetermined number of lines, for example, every three lines. In this case, according to the inventor's experiment, when the same light emission pattern continues, it is preferable for the number of the lines to be not more than 5 lines in consideration of remarkably suppressing the conspicuous white stripes and black stripes. In the case of the exposure head 106 of this embodiment in which the resolution in the main scanning direction is 1200 dpi, it has been found that the stripe becomes conspicuous when the same light emission pattern continues for 6 lines or more.

As another modification, the light emission pattern may be made different with a certain regularity. For example, after two continuous lines of the same light emission pattern, three lines of light emission patterns different from the previous light emission pattern may be continued. That is, the light emission pattern may be controlled with a certain regularity such as 2 lines, 3 lines, 2 lines, 3 lines, . . . . Even in this case, it is preferable that the continuous light emission pattern is set to 5 lines or less.

When the consideration is made particularly on the two light emitting elements arranged in the width direction of the substrate 202 in the duplications 1 to 28, it can be remarkably seen whether or not the light emission pattern when exposing one line and the light emission pattern when exposing another line as in the present invention, for example, in the case that a solid image is formed on one sheet of paper. In this case, one of the two light emitting elements arranged in the width direction of the substrate 202 emits light in each line. Therefore, even if the same light emission pattern is repeated for several lines incidentally, the same light emission pattern is rarely continued for all the lines on one sheet. Therefore, it can be easily confirmed that the light emission pattern is different between a certain line and another line. On the other hand, with the exposure head 106 to which the present invention is not applied, that is, in the case that the light emission pattern is the same for all lines, the stripes may appear remarkably when a solid image is formed on one sheet.

As has been described in the foregoing, in this example, in the overlapping portion of the light emitting elements of the light emitting element array chips 1 to 29, the selection control is carried out so that the image data is stored in one of the light emitting elements belonging to different array chips and corresponding to the same pixel position, and is selected for each line. By this, the influence of image stripes can be easily diffused against the occurrence of the widening of the gap between the adjacent surface emitting array chips generated resulting from the thermal expansion of the printed circuit board attributable to the heat generated by the exposure head. Therefore, there is no need to newly provide a means for measuring the gap between the surface emitting array chips, and the quality of the formed image can be easily improved.

Here, in this embodiment, the number of light emitting element array chips and the number of light emitting elements included in one light emitting element array chip have been described as 29 chips and 516 elements, respectively, but the present invention is not limited to this example. In addition, the pseudo-random number generator 534 may perform any process that randomly selects pixel data for the same pixel position of the duplicates 1 to 28 in either one of the memories 501 to 529, and it is not limited to the process using a linear feedback shift register (LFSR). Furthermore, in this embodiment, the number of overlapping light emitting elements of each light emitting element array chip 1 to 29 is four elements. If the number of overlapping light emitting elements is 2 or more, the effect of improving the quality of the image can be provided, and therefore, it is not limited to four elements.

As has been described in the foregoing, according to this embodiment, the image quality of the overlapping portion of the light emitting elements arranged in an overlapping manner can be improved.

Embodiment 2

In Embodiment 1, for the overlapping parts 1-2 of memory 501-529, the memories 501 to 529 are selected so that the pixel data read from the line memory 500 is stored in the same overlapping pixel position in one of the memories 501 to 529. In Embodiment 2, the control method is such that the pixel data of one pixel is divided at a desired ratio and stored in two memories 501 to 529.

[Pixel Data Division Control]

FIG. 18 is a block diagram of a structure of the duplication controller 533 of this embodiment. As compared to the structure of the duplication controller 533 shown in FIG. 16 of Embodiment 1, the duplication controller 533 of this embodiment is an image data distributor 537 for dividing and controlling one pixel data at a desired ratio. The image data distributor 537 includes a pixel division controller 538 which is a dividing portion, and two selectors 539 and 540. The pixel division controller 538 divides one pixel data read from the line memory 500 by way of the memory controller 532, on the basis of the pixel division ratio designated by the CPU 400, and then it outputs the divided two pixel data to the two selectors 539 and 540, respectively. The two selectors 539 and 540 receive the two pixel data sel_img1 and sel_img2 outputted from the pixel division controller 538 and the select signal from the pseudo-random number generator 534. Here, as in Embodiment 1, different signals are inputted to the two selectors 539 and 540, that is, a signal obtained by inverting the select signal inputted to the selector 539 is inputted to the selector 540. For example, when the select signal inputted to selector 539 indicates an input port 0, the select signal inputted to selector 540 indicates an input port 1.

The pixel data inputted from the pixel division controller 538 to the selectors 539 and 540 will be described in detail. Here, for example, it is assumed that the pixel division ratio instructed by the CPU 400 is 60%, and that one-pixel data (img1) having a 3-bit structure read from the line memory 500 by way of the memory controller 532 is "5". The pixel division controller 538 calculates two pixel data (sel_img1, sel_img2) to be outputted to the two selectors 539 and 540 in the following manner.

sel_img1='5'×0.6(60%)='3'.

sel_img2=img1('5')−sel_img1('3')='2'.

The two calculated pixel data (sel_img1, sel_img2) are outputted to the selectors 539 and 540. In the selectors 539 and 540, one image data is selected from the two inputted image data in accordance with the select signal ('0' or '1') from the pseudo random number generator 534 described in Embodiment 1, and outputs the selected signal. For example, when the select signal is '1', the selector 539 in FIG. 18 outputs sel_img1='3', and the selector 540 outputs sel_img2='2'. And, the image data outputted from the selectors 539 and 540 is stored for the duplicates 1 to 28 of the memories 501 to 529 by way of the overlapping pixel switching portion 535.

Other Embodiments

FIG. 19 is a control block diagram of the control board 415 and the driving substrate 202 including a different structure from the control block diagram shown in FIG. 4 of Embodiment 1. In FIG. 4 of Embodiment 1, the filter processing portion 408 is provided inside the driver 303*a* of the driving substrate 202. In FIG. 19, the filter processing portion 408 is provided inside the control board 415, and is positioned between the chip data shifting portion 404 and the data transmitting portion 405. As described above, the control board 415 may be constituted to transmit the pixel data subjected to the filter processing by the filter processing portion 408 to the driving substrate 202.

As has been described in the foregoing, in this embodiment, pixel data is divided in accordance with the divided pixel ratio instructed by the CPU 400 for each light emitting element in the overlapping portion of the light emitting elements of the light emitting element array chips 1 to 29. And, the divided pixel data is controlled to be stored in each of the memories 501 to 529, and the control processing is performed for each line. By this, the influence of image stripes can be easily diffused against the occurrence of the widening of the gap between the surface emitting array chips resulting from the thermal expansion of the printed circuit board attributable to the heat generated by the exposure head. Therefore, the additional means for measuring the gap between the surface emitting array chips is not required, and the quality of the formed image can be easily improved.

As has been described in the foregoing, according to this embodiment, the image quality of the overlapping portion of the light emitting elements arranged in an overlapping manner can be improved.

While the present invention has been described with reference to exemplary embodiments, it is to understood that the invention is not limited to the disclosed exemplary embodiments. The scope of the following claims is to be accorded the broadest interpretation so as to encompass all such modifications. and equivalent structures and functions.

This application claims the benefit of Japanese Patent Application No. 2018-219722 filed on Nov. 22, 2018, which is hereby incorporated by reference herein in its entirety.

What is claimed is:

1. An image forming apparatus comprising:

a rotatable photosensitive drum;

a substrate;

first and second chips provided on a side of said substrate and including a plurality of light emission elements arranged along a rotational axis of said photosensitive drum, said light emission elements being configured to expose said photosensitive drum to light emitted therefrom, for each of one line extending along the rotational axis; and a controller configured to control actuation of said light emitting elements on the basis of image data;

wherein said first chip and said second chip are arranged such that a part of said first chip and a part of said second chip are overlapped as seen in a direction perpendicular to the rotational axis, and wherein said controller controls a pattern of actuation and non-actuation of said light emission element in the overlapped part of said first chip and actuation and non-actuation of said light emission element in the overlapped part of said second chip, such that the pattern is different for every predetermined number of the lines.

2. An apparatus according to claim 1, wherein the predetermined number is an integer not more than five.

3. An apparatus according to claim 2, wherein said controller randomly changes the pattern for every predetermined number of lines.

4. An apparatus according to claim 1, further comprising a distributing portion, wherein when the light emission element of the overlapped part of said first chip is to be actuated, said distributing portion assigns the image data to said first chip, and when the light emission element of the overlapped part of said second chip is to be actuated, said distributing portion assigns the image data to said second chip.

5. An apparatus according to claim 4, wherein said distributing portion includes a first selector configured to output the image data or zero to said first chip, a second selector configured to output the image data or zero to said second chip, and an outputting portion configured to output a selection signal for selecting the image data or zero, to said first selector and said second selector, wherein said outputting portion outputs the selection signal such that when said first selector outputs the image data to said first chip, said second selector outputs zero to said second chip, and when said second selector outputs the image data to said second chip, said first selector outputs zero to said first chip.

6. An apparatus according to claim 5, wherein the selection signal is determined on the basis of random numbers.

7. An image forming apparatus according to claim 5, wherein said distributing portion includes a storing portion configured to store the selection signal for each light emitting element in the overlapped parts of said first and second chips, and wherein said outputting portion outputs the selection signal stored in said storing portion to said first selector and said second selector.

8. An apparatus according to claim 7, wherein said outputting portion outputs the selection signal determined on the basis of random numbers or the selection signal stored in said storing portion, in response to an instruction from said controller.

9. An apparatus according to claim 1, wherein said light emitting elements are light emitting diodes.

10. An apparatus according to claim 1, wherein said light emitting elements are organic light emitting diodes.

11. An image forming apparatus comprising:

a rotatable photosensitive drum;

a substrate;

first and second chips provided on a side of said substrate and including a plurality of light emission elements arranged along a rotational axis of said photosensitive drum, said light emission elements being configured to expose said photosensitive drum to light emitted therefrom, for each of one line extending along the rotational axis; and a controller configured to control actuation of said light emitting elements on the basis of image data;

wherein said first chip and said second chip are arranged such that a part of said first chip and a part of said second chip are overlapped as seen in a direction perpendicular to the rotational axis, and wherein said controller controls a pattern of relatively higher and lower intensities of the light emitted by said light emission element in the overlapped part of said first chip and said light emission element in the overlapped part of said second chip, such that the pattern is different for every predetermined number of the lines.

12. An apparatus according to claim 11, wherein the predetermined number is an integer not more than five.

13. An apparatus according to claim 12, wherein said controller randomly changes the pattern for every predetermined number of lines.

14. An apparatus according to claim 11, further comprising a distributing portion, wherein when the light emission element of the overlapped part of said first chip is to be actuated, said distributing portion assigns the image data to said first chip, and when the light emission element of the overlapped part of said second chip is to be actuated, said distributing portion assigns the image data to said second chip.

15. An apparatus according to claim 14, wherein said distributing portion includes a first selector configured to output the image data or zero to said first chip, a second selector configured to output the image data or zero to said second chip, and an outputting portion configured to output a selection signal for selecting the image data or zero, to said first selector and said second selector, wherein said outputting portion outputs the selection signal such that when said first selector outputs the image data to said first chip, said second selector outputs zero to said second chip, and when said second selector outputs the image data to said second chip, said first selector outputs zero to said first chip.

16. An apparatus according to claim 15, wherein the selection signal is determined on the basis of random numbers.

17. An apparatus according to claim 15, wherein said distributing portion includes a storing portion configured to store the selection signal for each light emitting element in the overlapped parts of said first and second chips, and wherein said output outputting portion outputs the selection signal stored in said storing portion to said first selector and said second selector.

18. An apparatus according to claim 17, wherein said outputting portion outputs the selection signal determined on the basis of random numbers or the selection signal stored in said storing portion, in response to an instruction from said controller.

19. An apparatus according to claim 11, wherein said light emitting elements are light emitting diodes.

20. An apparatus according to claim 11, wherein said light emitting elements are organic light emitting diodes.

* * * * *